US007364151B2

(12) United States Patent
Ito et al.

(10) Patent No.: US 7,364,151 B2
(45) Date of Patent: Apr. 29, 2008

(54) PLATE SUPPLYING APPARATUS

(75) Inventors: Kanji Ito, Kyoto (JP); Takashi Sakamoto, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 555 days.

(21) Appl. No.: 10/764,478

(22) Filed: Jan. 27, 2004

(65) Prior Publication Data

US 2004/0188915 A1 Sep. 30, 2004

(30) Foreign Application Priority Data

Jan. 30, 2003 (JP) ..... 2003-022609

(51) Int. Cl.
*B65H 3/46* (2006.01)

(52) U.S. Cl. ..... 271/106; 101/477

(58) Field of Classification Search ..... 271/11, 271/106, 107; 101/477

See application file for complete search history.

(56) References Cited

U.S. PATENT DOCUMENTS

| | | | | |
|---|---|---|---|---|
| 4,156,170 | A * | 5/1979 | Strunc | 318/696 |
| 4,212,263 | A * | 7/1980 | Hillhouse | 118/37 |
| 4,759,679 | A * | 7/1988 | Muller | 414/416.01 |
| 5,075,939 | A * | 12/1991 | Michitoshi et al. | 271/104 |
| 5,785,309 | A * | 7/1998 | Halup et al. | 271/11 |
| 6,675,712 | B2 * | 1/2004 | Marincic et al. | 101/477 |

FOREIGN PATENT DOCUMENTS

| | | |
|---|---|---|
| JP | 7-251966 | 10/1995 |
| JP | 08-242340 A | 9/1996 |
| JP | 9-071348 | 3/1997 |
| JP | 2004-131223 | 4/2000 |

OTHER PUBLICATIONS

Japanese Office Action issued in Japanese Patent Application No. 2003-022609 dated Nov. 7, 2007.

* cited by examiner

*Primary Examiner*—Patrick Mackey
*Assistant Examiner*—Thomas Morrison
(74) *Attorney, Agent, or Firm*—McDermott Will & Emery LLP

(57) ABSTRACT

A plate supplying apparatus 1 allows, when taking out a plate P from a cassette 2 and transporting the plate toward an image recording apparatus 8, a support section 33 to operate such that the pivot angle of the support section 33 follows an optimum path based on the type of a plate P to be transported. In addition, upon control of the pivot operation of the support section 33, it is not necessary to control the pivot position of the support section 33, and a rotation drive pulse RP is easily generated so as to synchronize with a linear motion drive pulse DP outputted from a control section of the image recording apparatus 8. In the plate supplying apparatus 1, when a plate P stored in the cassette 2 is held via suction, only suction pads 31 are brought into contact with a plate P to be transported, and when the plate P is transported by transport rollers 51 and 52, the suction pads 31 do not contact with the plate P.

16 Claims, 18 Drawing Sheets

FIG. 8

ROTATION DRIVE PATTERN TABLE

| LINEAR MOTION POSITION ADDRESS | ROTATION DRIVE PATTERN DATA |
|---|---|
| 0 | 0 |
| 1 | 0 |
| 2 | 1 |
| 3 | 1 |
| ⋮ | ⋮ |
| 200 | 0 |
| 201 | 1 |
| 202 | 0 |
| ⋮ | ⋮ |
| 1000 | 1 |
| 1001 | 1 |
| 1002 | 0 |
| ⋮ | ⋮ |

PLATE SUPPLYING APPARATUS

BACKGROUND OF THE INVENTION

1. Field of the Invention

The present invention relates to a plate supplying apparatus, and more particularly to a plate supplying apparatus for supplying a plate from a storage section where plates are stored, while reversing its faces.

2. Related Art Statement

A conventional plate supplying apparatus automatically supplies a plate, such as a presensitized (PS) plate, to an image recording apparatus for irradiating that plate with a laser beam to directly record an image thereon. The plate used with such an image recording apparatus is made up of a support layer and an image recording layer. Since the image recording layer is easily damaged, the utmost caution is required when taking out the plate.

The conventional plate supplying apparatus receives a cassette storing a plurality of plates. In the cassette, a slip sheet for preventing friction between plates may be provided between plates. However, in order to achieve efficient storing of plates into a cassette and to simplify the mechanism of a plate supplying apparatus, the use of the slip sheet may be abolished and only plates may be stored. For example, Japanese Patent Laid-Open Publication No. 8-242340 discloses a plate supplying apparatus which includes, for example, pad rods having plate suction cups. In the state where the plate suction cups secure a support layer side of a plate via suction, the pad rods move the plate suction cups to a predetermined position, so that the plate is taken out from a cassette, and then supplied to an image recording apparatus as described above.

Referring to FIGS. 17 and 18, the operation of the above-described conventional plate supplying apparatus 500 is described. FIG. 17 is a schematic view illustrating the construction of the plate supplying apparatus 500 and an image recording apparatus 600, and FIG. 18 is a view used for explaining a reference path for transporting a plate P.

In FIG. 17, a plurality of plates P to be supplied from the plate supplying apparatus 500 are stored in a cassette 510 placed in a slanting position, such that the support layer faces the side of a plate transport mechanism 520. The plate transport mechanism 520 transports the plates P from the cassette 510 to the image recording apparatus 600. The plate transport mechanism 520 includes a traveling member 524 which travels by receiving drive from an endless synchronous belt 522 looped over two pulleys 521*a* and 521*b* which are caused to pivot by drive of a motor M523. The traveling member 524 has an arm 526 secured thereon. At an end of the arm 526, there are provided a plurality of suction pads 525 for holding the plate P via suction. The suction pads 525 are provided so as to be in a proper position with respect to the plates P stored in the cassette 510.

In the case where the plate transport mechanism 520 having the above-described construction is in a state A where the motor M523 drives the synchronous belt 522 in a counterclockwise direction, whereby the traveling member 524 takes out a plate P stored in the cassette 510, when the traveling member 524 moves toward a direction to the left (hereinafter referred to as the "linear motion direction"), the arm 526 and the suction pads 525 pivot in a counterclockwise direction (hereinafter, referred to as the "transport rotation direction"). Therefore, in the case where the suction pads 525 hold a support layer side of a plate P via suction in state A, and then the traveling member 524 is moved by drive of the motor M523 toward the linear motion direction, when the arm 526 and the suction pads 525 pivot in the transport rotation direction, the plate P held via suction by the suction pads 525 is turned such that the plate's faces are reversed (i.e., the support layer of the plate P faces downwards). Thereafter, the plate P is transported to a transport unit 620 included in the image recording apparatus 600. Note that the angle of rotation in the transport rotation direction with respect to the movement in the linear motion direction is uniquely fixed. Then, the transport unit 620 transports the plate P having been turned and transported by the plate transport mechanism 520, to a recording drum 610. In the recording drum 610, the plate P is secured.

Another exemplary pivot system in the plate transport mechanism 520 may be such that the traveling member 524 includes a reduction gear (not shown) having a pinion to be engaged with a rack rail (not shown) provided in parallel with the synchronous belt 522, and the reduction gear has the arm 526 secured on an output shaft thereof. In this construction, when the traveling member 524 moves in the linear motion direction, the pinion is engaged with the rack rail and rotated, whereby the output shaft of the reduction gear also rotates at a predetermined deceleration. Accordingly, the arm 526 secured on the output shaft of the reduction gear and the suction pads 525 also pivot about the center of the output shaft of the reduction gear at a predetermined deceleration in the transport rotation direction. Note that the angle of rotation in the transport rotation direction with respect to the movement in the linear motion direction can be adjusted to any value by changing the deceleration, but once adjusted, the angle of rotation is uniquely fixed.

Next, referring to FIG. 18, the angle in the transport rotation direction of a plate P with respect to the movement in the linear motion direction is described. As described above, the image recording layer of a plate P is easily damaged, and thus, friction between a plate P taken out from the cassette 510 and another plate P which remains stored in the cassette 510 needs to be prevented. For this purpose, the plate to be transported will attain an optimum path if the upper end of the plate to be transported follows a line slightly below a "reference path", where the reference path is defined as an arc of a circle whose radius is the length of a plate stored in the cassette 510 and whose center is the lower end of the plate. If the upper end of the plate follows a line above the reference path, the plate P will be dragged upwards, thus causing friction between the plate P being transported and another plate in the cassette 510. On the other hand, if the upper end of the plate follows a line too far below the reference path, a reaction force that causes the plate P to return to its flat state may exceed the suction force of the suction pads 525, and cause the suction pads 525 to be detached from the plate P, especially when taking out a plate P with high flexibility (stiffness) from the cassette 510.

Now, the case of transporting a plate P1, shown in FIG. 18, is described. For simplicity of description, it is conveniently assumed that the "optimum path" is attained if the upper end of a plate P to be transported just follows the reference path. The plate P1 with length L1 is taken out from the cassette 510 by the plate transport mechanism 520 such that the upper end of the plate P1 follows an arc R1. The suction pads 525 suck the upper end of the plate P1 stored in the cassette 510 at a point e0 (i.e., at the position of the suction pads 525 in the above-described state A). Although the illustration of FIG. 18 is simplified so that the suction pads 525 appear to be sucking at the upper end of the plate P1, the suction pads 525 will suck somewhat below the upper end in practice. It is further assumed that the pivotal point of the arm 526 when the suction pads 525 are situated at the point e0 is S0, and that the arm 526 constitutes an angle of θ0 with respect to the horizontal direction. In order to prevent friction between the plate P1 to be taken out and another plate P1 stored in the cassette 510, the plate P1 to be taken out needs to be removed from the cassette 510 without allowing a lower end f1 thereof to be displaced with respect to the plate P1 stored in the cassette 510. That is, the reference path should be such that the suction pads 525 travel from the point e0 to a midpoint e1 along the arc R1 having the radius L1 and a center at the lower end f1.

As described above, the angle of rotation in the transport rotation direction, as a function of the movement in the linear motion direction, is uniquely fixed. In the plate transport mechanism 520, this presents a difficulty in transporting plates P having different lengths, for example, while preventing the above-described friction and large bending stress.

For example, in FIG. 18, in the case of a plate P1 with length L1, the arm 526, when the suction pads 525 are situated at the transport midpoint e1, has a pivotal point of S1 and an angle θ1 with respect to the horizontal direction. As the plate P1 is transported, the suction pads 525 move along the path of the arc R1, which is the reference path. However, the following problem arises when the same plate transport mechanism 520 is used to transport a plate P2 with length L2 which is greater than the length L1 (in FIG. 18, the plate P2 is indicated by a broken line to distinguish it from the plate P1).

The suction pads 525 will start to suck the plate P2 stored in the cassette 510 at the point e0, which is the same as that for the plate P1. The arm 526, when the suction pads 525 are situated at the point e0, has a pivotal point of S0 and an angle θ0 with respect to the horizontal direction. The reference path should be such that the plate P2 is transported along the arc R2 having the radius L2 and a center at the lower end f2. Thus, the reference path for transporting the plate P1 is different from that for transporting the plate P2. Specifically, in the case where the plate P2 with the length L2 is transported, the arm 526 constitutes an angle of θ2 with respect to the horizontal direction when the suction pads 525 are situated at the midpoint e2. That is, in the case of transporting the plate P2, the degree of change in the angle of rotation in the transport rotation direction as a function of the amount of movement in the linear motion direction needs to be made greater than that in the case of transporting the plate P1. For example, if the plate P1 is transported by setting the angle of rotation according to the plate P2, the plate P1 will be damaged due to the friction between the plate P1 and another plate, etc. On the other hand, if the plate P2 is transported by setting the angle of rotation according to the plate P1, an unwanted bending pressure will be applied to the plate P2, and as a result, the suction pads 525 may be detached from the plate P2 because of the flexibility (stiffness) of the plate P2.

As described above, since the reference path for transporting a plate varies depending on the length of a plate P to be transported, if the angle of rotation in the transport rotation direction with respect to the movement in the linear motion direction is uniquely fixed, it is difficult to support various paths. In addition, the above-described "optimum path" may also vary with factors such as changes in the remaining number of plates P stored in the cassette 510, differences in the thickness of plates P to be transported, and differences in the flexibility (stiffness) of plates P. Thus, what is needed is an ability to support various "optimum paths" while taking into account various factors.

SUMMARY OF THE INVENTION

Therefore, an object of the present invention is to provide a plate supplying apparatus that prevents a plate to be transported from getting damaged and prevents a plate being transported from falling, when taking out a plate from a cassette and transporting the plate toward an image recording apparatus.

The present invention has the following features to attain the object mentioned above. A first aspect of the present invention is directed to a plate supplying apparatus for transporting and supplying a stack of plates one by one while reversing faces of each plate, the apparatus comprising: a storage section for storing a stack of plates; a plate suction section for sucking around an end portion of a plate to be transported which is stored in the storage section; a support section for supporting the plate suction section; a linear motion drive mechanism for moving the plate suction section and the support section in a plate transport direction; a rotation drive mechanism for turning the plate sucked by the plate suction section by pivoting the plate suction section and the support section, independently of the movement of the plate suction section and the support section in the plate transport direction; a linear motion drive mechanism control section for controlling an operation of the plate suction section and the linear motion drive mechanism; a rotation drive mechanism control section for adjusting a pivot angle by which the rotation drive mechanism allows the plate suction section and the support section to pivot, in accordance with the amount of movement of the support section in the plate transport direction per unit; and a supplying section for supplying the plate sucked by the plate suction section and transported toward another equipment device.

According to the first aspect of the invention, when a plate is taken out from the storage section and transported toward another equipment device, the plate suction section and the pivot angle of the support section can be adjusted so as to follow an optimum path based on the type of a plate to be transported, and thus it is possible to prevent a plate to be transported from getting damaged and to prevent a plate being transported from falling. In addition, a slip sheet for preventing friction between plates does not need to be provided alternately between plates stored in the storage section, and thus the number of man-hours needed to provide the slip sheets is reduced and also a mechanism for taking out slip sheets from the storage section can be withdrawn, whereby a great cost reduction is achieved.

The above-described rotation drive mechanism control section may adjust the pivot angle until the plate is removed from the storage section, such that the end portion of the plate follows a line deviated from at least a reference path, which is an arc of a circle whose center is an other end portion of the plate and whose radius is the length of the plate, toward the other end portion of the plate. This avoids the end portion of a plate to be transported from following a line above the reference path, and therefore the other end portion of the plate cannot be dragged upwards from the storage section in a manner causing friction between the plate and another plate. Accordingly, it is possible to prevent a plate to be transported from getting damaged. In one example, the rotation drive mechanism control section may perform a separation operation by adjusting the pivot angle such that the amount of deviation of the end portion from the reference path is greater at a point when the end portion of the plate has just been lifted off other plates stored in the storage section than other points in the plate transport direction. In another example, the rotation drive mechanism control section may adjust the pivot angle such that a ratio of the pivot angle to the amount of movement of the support section in the plate transport direction per unit is different between before and after the plate is removed from the storage section.

The above-described linear motion drive mechanism control section may generate linear motion drive pulses for driving the linear motion drive mechanism and output the linear motion drive pulses to the linear motion drive mechanism. In this case, the rotation drive mechanism control section may generate rotation drive pulses for driving the rotation drive mechanism, by removing at least one of the linear motion drive pulses generated by the linear motion drive mechanism control section, and output the rotation drive pulses to the rotation drive mechanism. By providing the rotation drive mechanism control section independently of the linear motion drive mechanism control section, the processing load of the linear motion drive mechanism control section can be reduced. By adding the rotation drive mechanism control section to a conventional control section, a control section for controlling a plate supplying apparatus can be easily configured. Since the rotation drive mechanism control section generates rotation drive pulses by removing at least one of the linear motion drive pulses outputted, the rotation drive mechanism control section can be realized with a simple circuit configuration. In addition, the rotation drive mechanism control section may include a rotation drive pattern memory in which a rotation drive pattern table is prestored so as to conform to plates stored in the storage section, the rotation drive pattern table describing whether or not to drive the rotation drive mechanism in association with linear motion position addresses of the support section in the plate transport direction. In this case, the rotation drive mechanism control section may retrieve, by referring to the rotation drive pattern table, information about whether or not to drive the rotation drive mechanism with respect to a linear motion position address calculated using the linear motion drive pulses, and generate, if the rotation drive mechanism is not driven, the rotation drive pulses from which the linear motion drive pulses corresponding to the rotation drive are removed. By prestoring a rotation drive pattern table in the rotation drive pattern memory, a transport operation can be performed at an appropriate pivot angle based on the type of a plate to be transported. In addition, since the rotation drive mechanism control section generates rotation drive pulses in accordance with a rotation drive pattern table, by removing at least one of the linear motion drive pulses outputted, the rotation drive mechanism control section can be realized with a simple circuit configuration. In one example, the rotation drive pattern memory may have prestored therein a plurality of the rotation drive pattern tables adapted to the respective plates expected to be stored in the storage section. In this case, the rotation drive pattern table used by the rotation drive mechanism control section when generating the rotation drive pulses may be selected by an instruction of the linear motion drive mechanism control section. Accordingly, the pivot angle can be adjusted with an appropriate rotation drive pattern, in accordance with the instruction of the linear motion drive mechanism control section. In the rotation drive pattern table, a pattern for taking out the plate from the storage section may be different from a pattern for moving the plate suction section and the support section toward the storage section. Specifically, the plurality of the rotation drive pattern tables may be prestored in the rotation drive pattern memory in accordance with the size, type, or remaining number of plates to be stored in the storage section. Accordingly, the pivot angle can be adjusted with an appropriate rotation drive pattern, in accordance with the size or type of a plate to be transported or the remaining number of plates.

The above-described support section may support the plate suction section via compression springs so as to move up and down. In this case, when the plate suction section sucks a plate stored in the storage section, the plate suction section may be moved and placed in a direction outward from a center of pivot of the plate suction section and the support section by means of its weight and a pressing force of the compression springs. Accordingly, when the plate stored in the storage section is sucked, first the plate suction section contacts with the plate, and thus stable contact and suction operations can be performed on the plate. In addition, in the case where the support section further moves in the counter plate transport direction after the plate suction section have contacted with the plate, the compression springs are compressed, whereby the impact force given to the plate P can be reduced. The plate supplying apparatus may further comprise: a roller section for supporting the plate, which is provided in the plate suction section via extension springs so as to move up and down; and roller guide rails for guiding, when the plate supported by the plate suction section and the roller section is taken out to the supplying section, the roller section to a predetermined position with respect to the center of pivot. In this case, when the plate is taken out to the supplying section, a supply of negative pressure to the plate suction section may be terminated and the plate suction section may be moved and placed in a direction inward toward the center of pivot by means of its weight. Accordingly, when a plate is taken out by the supplying section, the plate suction section does not contact with the plate, and thus the occurrence of damage to a plate P to be transported can be further prevented and a stable transport of a plate P is achieved.

The above-described storage section may include a cassette which stores the plates in a slanting position. The plate transport direction may be a horizontal direction. The plates maybe stored in the cassette such that their image recording layers face downwards, and the plate suction section may suck a support layer of the plate stored in the cassette, the support layer being an opposite side of the image recording layer. The supplying section may supply the plate taken out from the cassette toward a cylindrical recording drum, and the plate may be mounted around a perimeter of the recording drum such that the image recording layer faces outwards. The linear motion drive mechanism may include: linear shafts which extend horizontally; linear motion bases which travel along the linear shafts; and a motor for allowing the linear motion bases to travel along the linear shafts, wherein: the plate suction section and the support section may be placed so as to rotate freely with respect to the linear motion bases; and the rotation drive mechanism may include a motor for rotating the plate suction section and the support section with respect to the linear motion bases, which is secured to the linear motion bases.

These and other objects, features, aspects and advantages of the present invention will become more apparent from the following detailed description of the present invention when taken in conjunction with the accompanying drawings.

BRIEF DESCRIPTION OF THE DRAWINGS

FIG. 8 shows an exemplary rotation drive pattern table stored in a rotation drive pattern memory 112 illustrated in FIG. 7;

DESCRIPTION OF THE PREFERRED EMBODIMENTS

Figure 1:
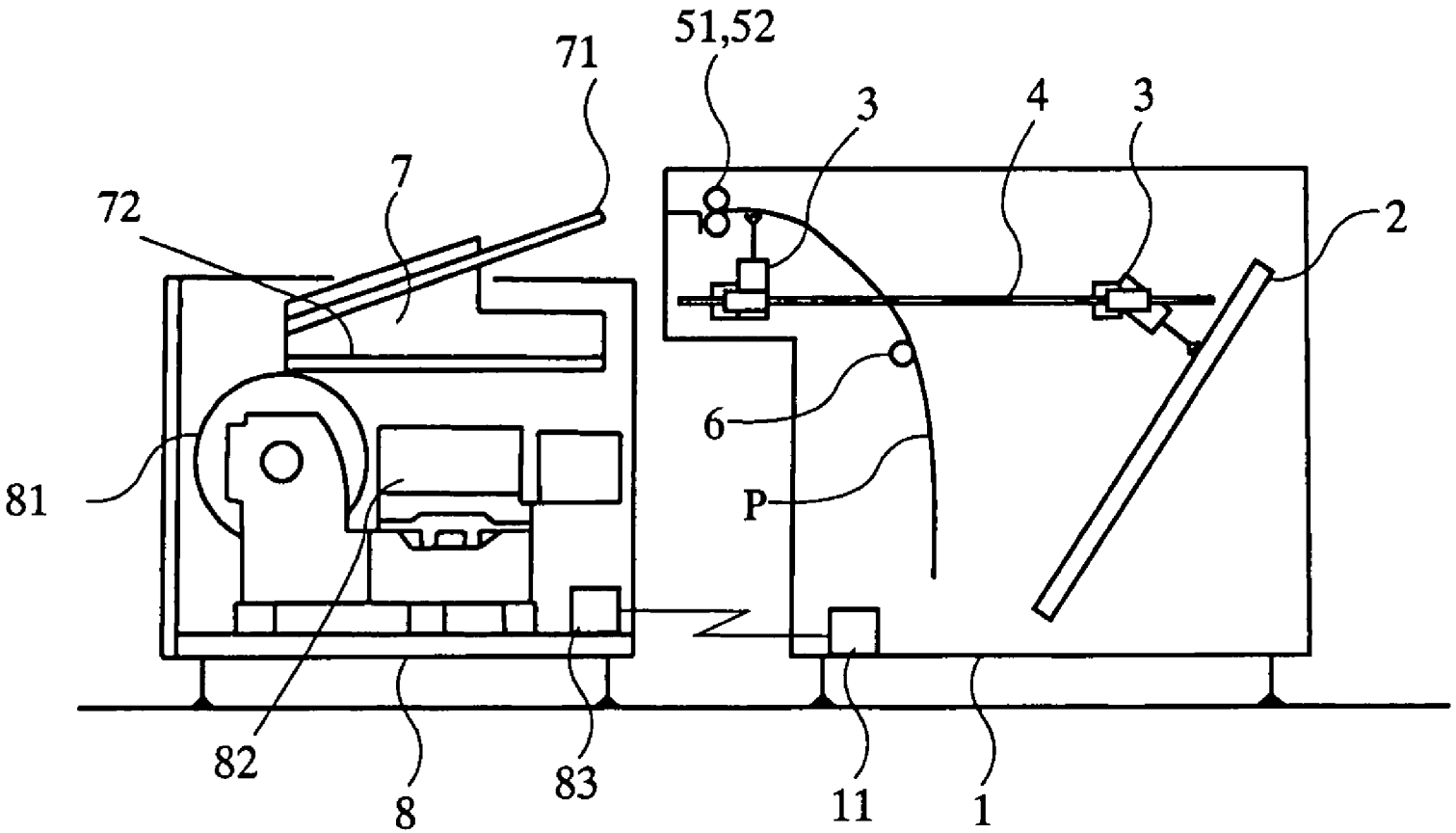
FIG. 1 is a schematic side view of an image recording system including a plate supplying apparatus 1 according to one embodiment of the present invention.

A plate supplying apparatus according to one embodiment of the present invention is described. FIG. 1 is a schematic side view of an image recording system including the plate supplying apparatus.

In FIG. 1, the image recording system including the plate supplying apparatus comprises: a plate supplying apparatus 1 for taking out and transporting a plate P stored in a cassette 2; an image recording apparatus 8 for recording an image onto the plate P; a feed and discharge tray section 7 for supplying the plate P transported by the plate supplying apparatus 1 to the image recording apparatus 8 and storing the plate P having an image recoded thereon; and a plate developing apparatus (not shown) for developing the plate having an image recorded thereon by the image recording apparatus 8.

The plate P to be stored in the cassette 2 is, for example, a presensitized (PS) plate composed of a support layer and an image recording layer. A plurality of plates P are stacked into the cassette 2 outside the plate supplying apparatus 1, such that their image recording layers face downwards, without employing slip sheets for preventing friction between plates. Therefore, the plate supplying apparatus 1 does not require a mechanism for removing slip sheets. In addition, regardless of changing sizes of the plates P, the plates P are always stored in the cassette 2 such that the upper end of each plate P is placed at a predetermined position. This can be realized by pre-adjusting the position of a member provided in the cassette 2 for supporting the lower end of a plate P, in accordance with the size of the plate P to be stored. The cassette 2 is inserted into and ejected from the plate supplying apparatus 1 by means of a cassette carriage (not shown).

The plate supplying apparatus 1 transports to the image recording apparatus 8 a plate P stored in the cassette 2, which is placed in the plate supply position illustrated in FIG. 1. The plate supplying apparatus 1 includes: a plate transport mechanism 3 having pad rods each including suction pads which will be described later; a linear motion drive mechanism 4 for moving the plate transport mechanism 3 along the horizontal direction in the figure (hereinafter, the leftward direction in FIG. 1 will be referred to as the "linear motion direction" and the rightward direction in FIG. 1 will be referred to as the "counter linear motion direction"); a pair of transport rollers 51 and 52 for feeding a plate P having been transported by the plate transport mechanism 3 to a feed and discharge tray section 7; a guide section 6 for guiding a plate being transported and the plate transport mechanism 3; and a plate supplying apparatus control section 11 for controlling a pivot mechanism, which will be described later, included in the plate transport mechanism 3. The support layer side of a plate P stored in the cassette 2 placed in the plate supply position is held via suction by the suction pads of the plate transport mechanism 3, and then reversed by causing the pad rods to move in the linear motion direction while pivoting. Thereafter, as illustrated in FIG. 1, the plate P is transported toward the transport rollers 51 and 52. The plate P transported toward the transport rollers 51 and 52 is then transported to a plate feed tray 71 of the feed and discharge tray section 7, with the support layer of the plate P facing downwards.

The image recording apparatus 8 includes a cylindrical recording drum 81, a recording head 82, and an image recording apparatus control section 83. The recording drum 81 is used to mount a plate P around the perimeter thereof, and driven by a motor (not shown) so as to rotate about its cylindrical shaft. The recording head 82 is used to record an image on the plate P mounted around the perimeter of the recording drum 81. The recording head 82 includes a large number of light emitting devices for outputting optical beams obtained via modulation performed in accordance with an image signal or the like. The image recording apparatus control section 83 controls the operation of each mechanism included in the image recording apparatus 8 and the plate supplying apparatus 1. In addition, the image recording apparatus control section 83 allows the plate supplying apparatus control section 11 to transmit data via a predetermined data transmission line. The plate supplying apparatus control section 11 and the image recording apparatus control section 83 may be integrally provided in either the image recording apparatus 8 or the plate supplying apparatus 1. The details of the operation of the plate supplying apparatus control section 11 and the image recording apparatus control section 83 will be described later.

A plate P placed in the plate feed tray 71 is transported to the recording drum 81 provided in the image recording apparatus 8. Then, the plate P is mounted around the perimeter of the recording drum 81 with its image recording layer facing outwards, and then rotated about the cylindrical shaft of the recording drum 81. In this state, the recording head 82 irradiates the image recording layer with optical beams obtained via modulation performed in accordance with an image signal or the like. Thereafter, the plate P having an image recorded thereon is discharged into a plate discharge tray 72.

Figure 2:
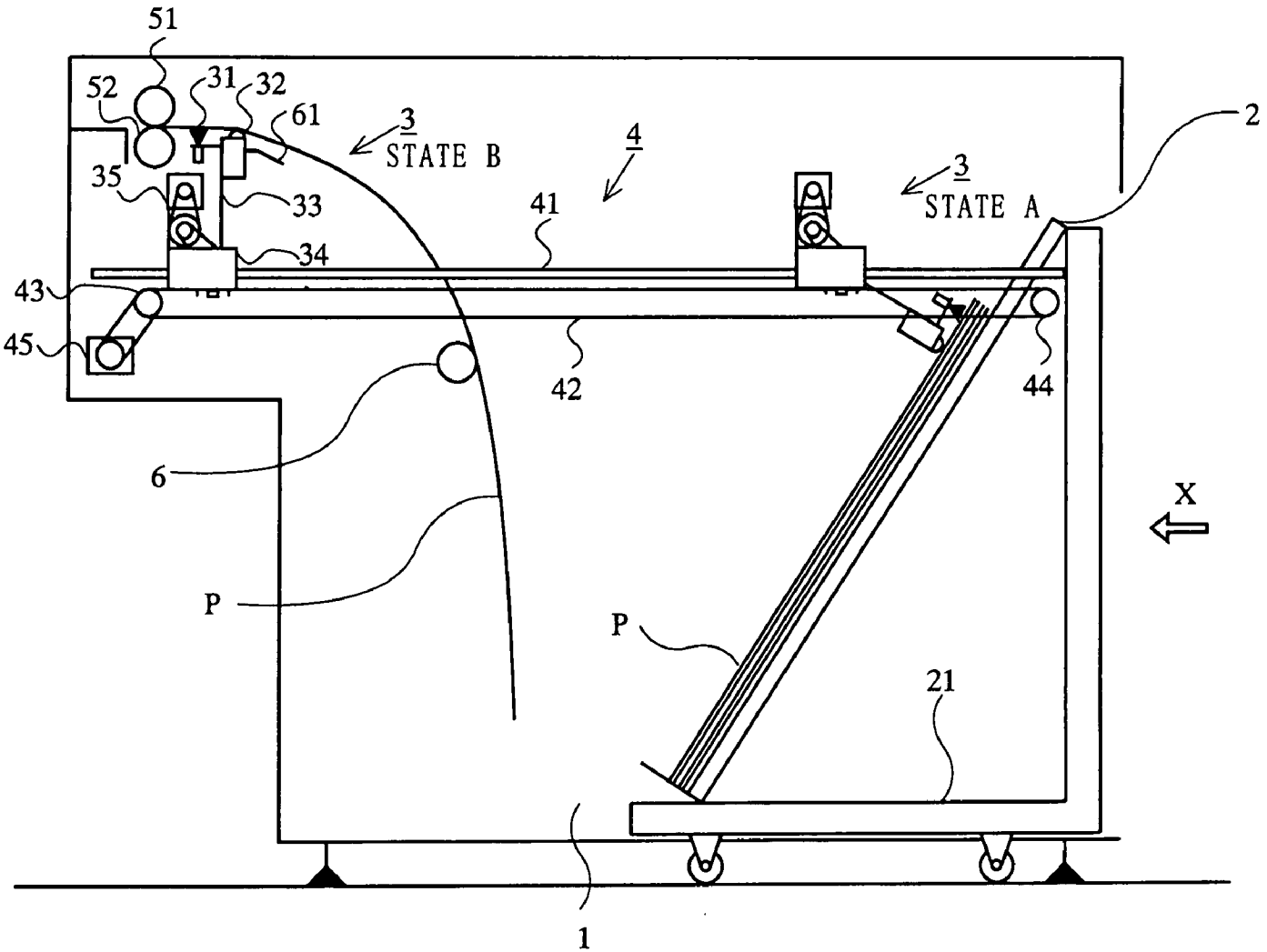
FIG. 2 is a schematic side view illustrating the schematic operation of a plate transport mechanism 3 and a linear motion drive mechanism 4 viewed from a side direction of the plate supplying apparatus 1 illustrated in FIG. 1.
Figure 3A:
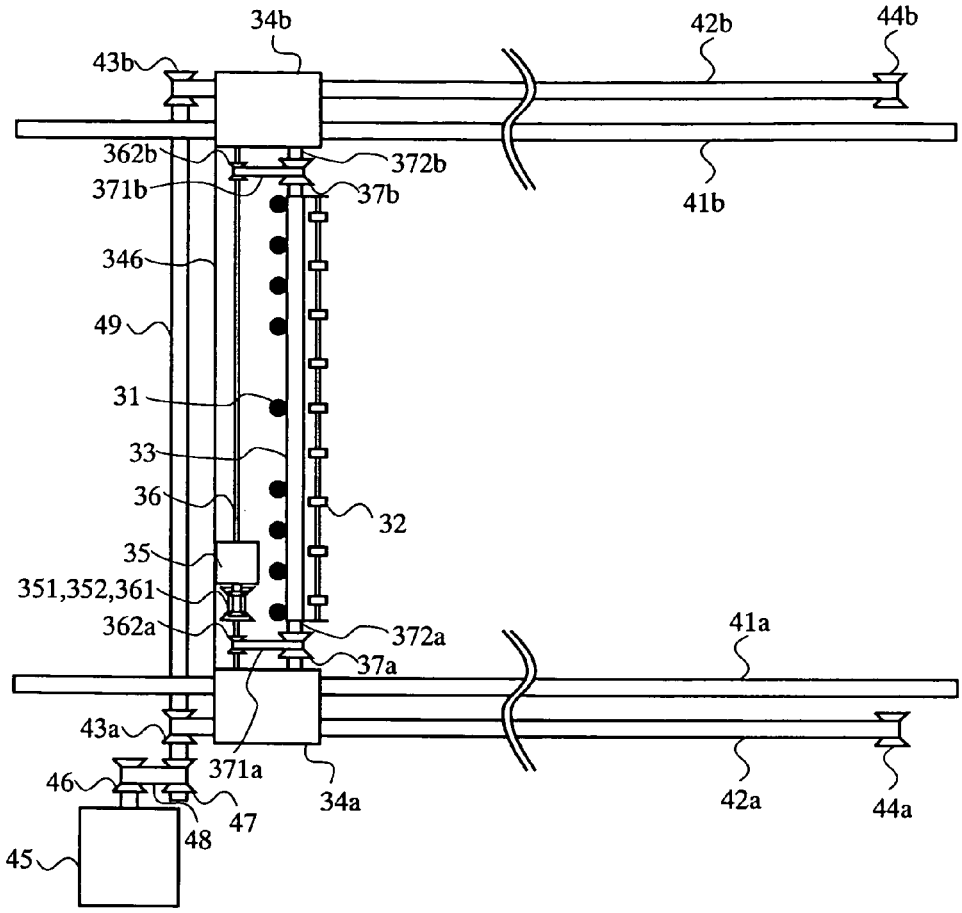
FIG. 3A is a schematic top view illustrating the schematic construction of only the plate transport mechanism 3 and the linear motion drive mechanism 4 illustrated in FIG. 2.
Figure 3B:
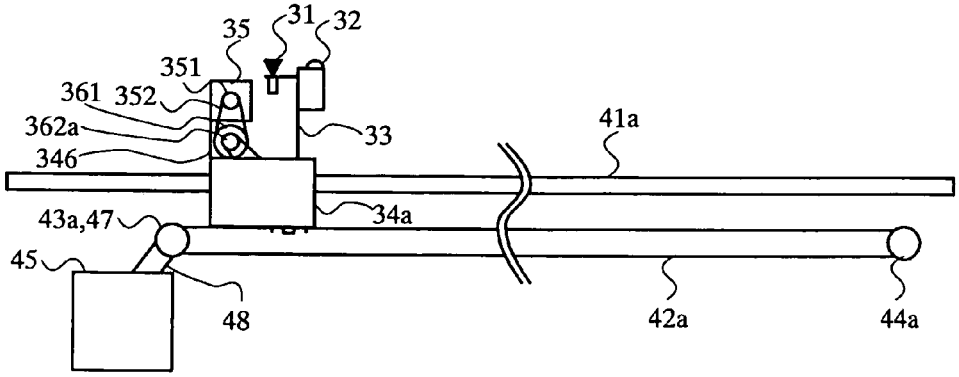
FIG. 3B is a schematic side view illustrating the schematic construction of only the plate transport mechanism 3 and the linear motion drive mechanism 4 illustrated in FIG. 2.

Next, referring to FIGS. 2 and 3, the schematic structure and transport operation of the plate transport mechanism 3 and the linear motion drive mechanism 4 for transporting a plate P from the cassette 2 placed in the plate supply position toward the transport rollers 51 and 52 are described. FIG. 2 is a schematic side view illustrating the schematic operation of the plate transport mechanism 3 and the linear motion drive mechanism 4 viewed from a side direction of the plate supplying apparatus 1, FIG. 3A is a schematic top view illustrating the schematic construction of only the plate transport mechanism 3 and the linear motion drive mechanism 4, and FIG. 3B is a schematic side view of FIG. 3A. Note that the plate transport mechanism 3 and the linear motion drive mechanism 4 have pairs of elements. In the following descriptions of the plate transport mechanism 3 and the linear motion drive mechanism 4, "a" is added to each reference numeral of one of the pair of elements (i.e., the element on the front side shown in FIG. 2), and "b" is added to each reference numeral of the other one of the pair of elements. In the pairs of elements, elements having the same construction or similarly operated may be generically denoted by the same reference numerals without "a" or "b" added thereto.

In FIGS. 2 and 3, the linear motion drive mechanism 4 includes linear shafts 41, synchronous belts 42 and 48, drive pulleys 43, 44, 46, and 47, a linear motion drive motor 45, and a drive transmission shaft 49. The plate transport mechanism 3 includes suction pads 31, sponge collars 32, a support section 33, linear motion bases 34, a coupling stay 346, a pad rotation drive motor 35, a drive transmission shaft 36, drive pulleys 351, 361, 362, and 37, synchronous belts 352 and 371, and a pad rotary shaft 372.

The cassette 2 is placed in the plate supply position (i.e., the position shown in FIG. 2) by moving the cassette carriage 21 from the outside of the plate supplying apparatus 1 in the X direction shown in the figure. As described earlier, regardless of changing sizes of the plates P, the plates P are always stored in the cassette 2 such that the upper end of each plate P is placed at a fixed position. The plate transport mechanism 3 transports a plate P from the cassette 2 toward the transport rollers 51 and 52. The plate transport mechanism 3 includes a pair of linear motion bases 34*a* and 34*b* which travel along linear shafts 41*a* and 41*b* provided in parallel along the horizontal direction in the figure, by receiving drive from endless synchronous belts 42*a* and 42*b* which are caused to rotate by drive of the linear motion drive motor 45. The synchronous belts 42*a* and 42*b* are respectively looped over drive pulleys 43*a* and 44*a* and 43*b* and 44*b* so as to rotate. A drive force of the linear motion drive motor 45 is transmitted to the synchronous belts 42*a* and 42*b* by the rotation of the drive pulleys 43*a* and 43*b* via the synchronous belt 48. The synchronous belt 48 is looped over the drive pulleys 46 and 47 so as to rotate, and the drive pulley 46 is secured on the output shaft of the linear motion drive motor 45. The drive pulleys 47, 43*a*, and 43*b* are secured on the common drive transmission shaft 49. The linear motion drive motor 45 rotates the drive pulleys 47, 43*a*, and 43*b* in phase with each other in the rotation direction thereof. The linear motion bases 34*a* and 34*b* each have a coupling member, as will be described later. The synchronous belts 42*a* and 42*b* are respectively sandwiched between the coupling members and the linear motion bases 34*a* and 34*b* so as to receive the drive therefrom.

A pair of the linear motion bases 34*a* and 34*b* are coupled by the coupling stay 346 such that their positions are fixed relative to each other. The coupling stay 346 has the pad rotation drive motor 35 secured thereon. The output shaft of the pad rotation drive motor 35 has the drive pulley 351 secured thereon. Between a pair of the linear motion bases 34*a* and 34*b*, the drive transmission shaft 36 is provided in the direction connecting the linear motion bases 34*a* and 34*b*, so as to rotate. The drive transmission shaft 36 has the drive pulleys 361, 362*a*, and 362*b* secured thereon. The synchronous belt 352 is looped over the drive pulleys 351 and 361 so as to rotate. By drive of the pad rotation drive motor 35, the drive pulleys 361, 362*a*, and 362*b* are rotated in phase with each other in the rotation direction of the pad rotation drive motor 35. A pair of the linear motion bases 34*a* and 34*b* have the pad rotary shafts 372*a* and 372*b* provided on the same axis so as to rotate. The pad rotary shafts 372*a* and 372*b* have the drive pulleys 37*a* and 37*b* secured thereon, respectively. The synchronous belts 371*a* and 372*b* are respectively looped over the drive pulleys 362*a* and 37*a* and 362*b* and 37*b* so as to rotate. That is, by drive of the pad rotation drive motor 35, the drive pulleys 361, 362*a*, 362*b*, 37*a*, and 37*b* are rotated in phase with each other in the rotation direction of the pad rotation drive motor 35, whereby the pad rotary shafts 372*a* and 372*b* are also rotated in phase with each other. The pad rotary shafts 372*a* and 372*b* are secured at both ends of the support section 33 having a plurality of the suction pads 31 and a plurality of the sponge collars 32 provided thereon.

Such construction of the plate transport mechanism 3 and the linear motion drive mechanism 4 allows the plate transport mechanism 3 to move along the linear shafts 41 in the above-described linear motion direction and counter linear motion direction, in accordance with the rotation of the linear motion drive motor 45. In addition, the support section 33 included in the plate transport mechanism 3 can rotate about the shafts (the pad rotary shafts 372*a* and 372*b*), which connect between a pair of the linear motion bases 34*a* and 34*b*, in accordance with the rotation of the pad rotation drive motor 35. That is, the support section 33 can pivot in a clockwise or counterclockwise direction in FIG. 2 (hereinafter the counterclockwise direction is referred to as the "transport rotation direction"), independently of the movement in the above-described linear motion direction and counter linear motion direction. Accordingly, the suction pads 31 and the sponge collars 32 provided to the support section 33 can also move similarly in the linear motion direction and counter linear motion direction and pivot in the above-described manner.

In the plate transport mechanism 3 and the linear motion drive mechanism 4 having the above-described construction, when the suction pads 31 hold via suction around an end portion of the support layer side of a plate P stored in the cassette 2 (i.e., the state A illustrated in FIG. 2), the pivot angle of the support section 33 is controlled such that the suction pads 31 are vertical to the plate P stored in the cassette, and the entire plate transport mechanism 3 moves in the counter linear motion direction. Then, in state A, while the linear motion bases 34 move in the linear motion direction by drive of the linear motion drive motor 45, the support section 33 rotates in the above-described transport rotation direction at a predetermined rotation angle in accordance with the position of the linear motion direction, and the end portion of the plate P is sandwiched between the transport rollers 51 and 52 (i.e., the state B illustrated in FIG. 2). In the plate transport mechanism 3 in state B, the support section 33 is controlled to be in an upright position (i. e., the suction surfaces of the suction pads 31 face upward), and the sponge collars 32 are guided to a predetermined position by a pair of sponge collar guide rails 61 secured on side surfaces of the main unit of the plate supplying apparatus 1. Subsequently, in state B, the plate P to be transported is supported by the suction pads 31, the sponge collars 32, and a guide member 6. A detailed description of how the plate P is supported is provided later.

Figure 4:
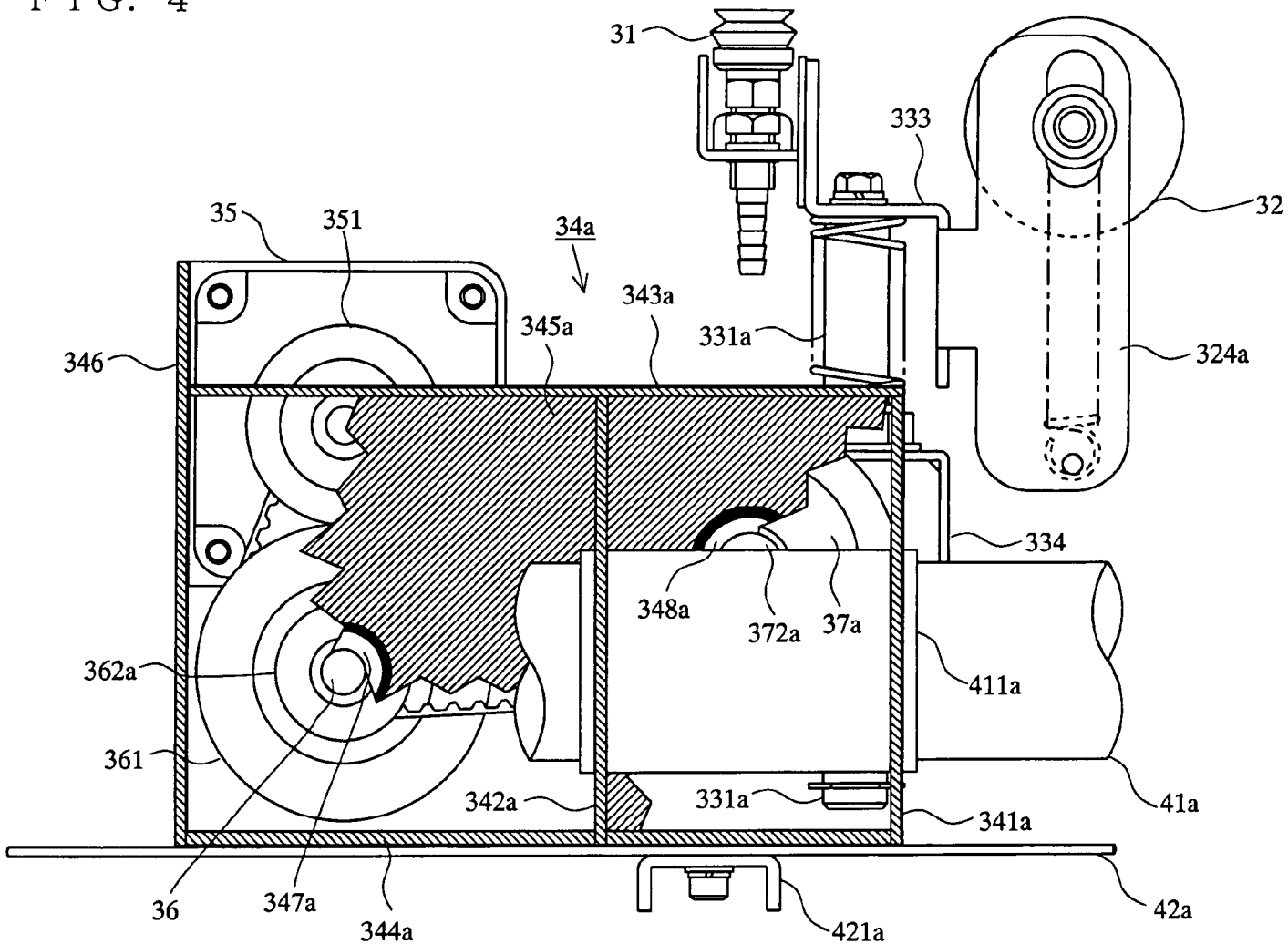
FIG. 4 is a side view illustrating the structure of the plate transport mechanism 3 in which a part of a linear motion base 34*a* illustrated in FIG. 3 is removed.
Figure 5:
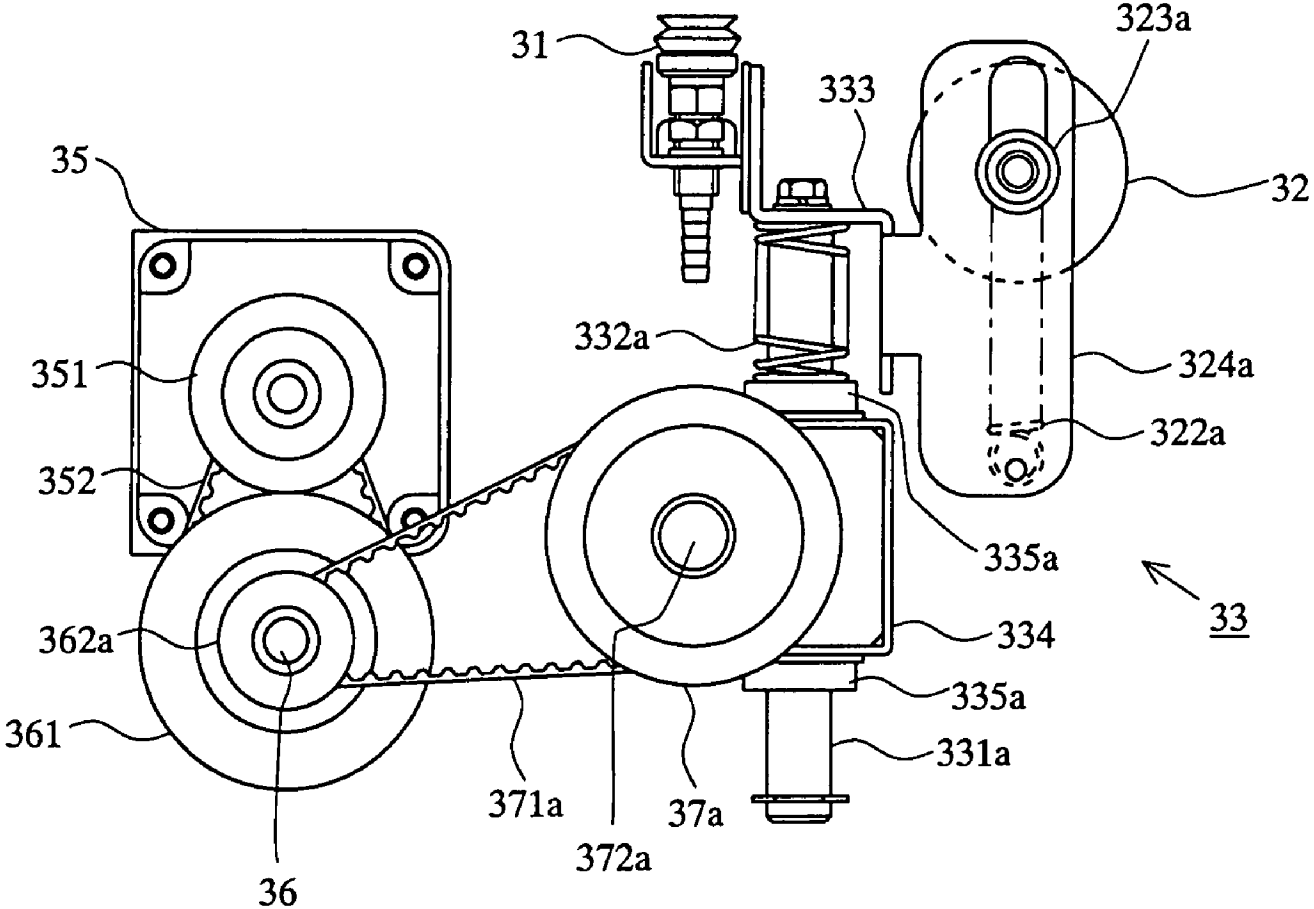
FIG. 5 is a side view illustrating the structure of the plate transport mechanism 3 in which the linear motion base 34*a* illustrated in FIG. 3 is omitted.
Figure 6:
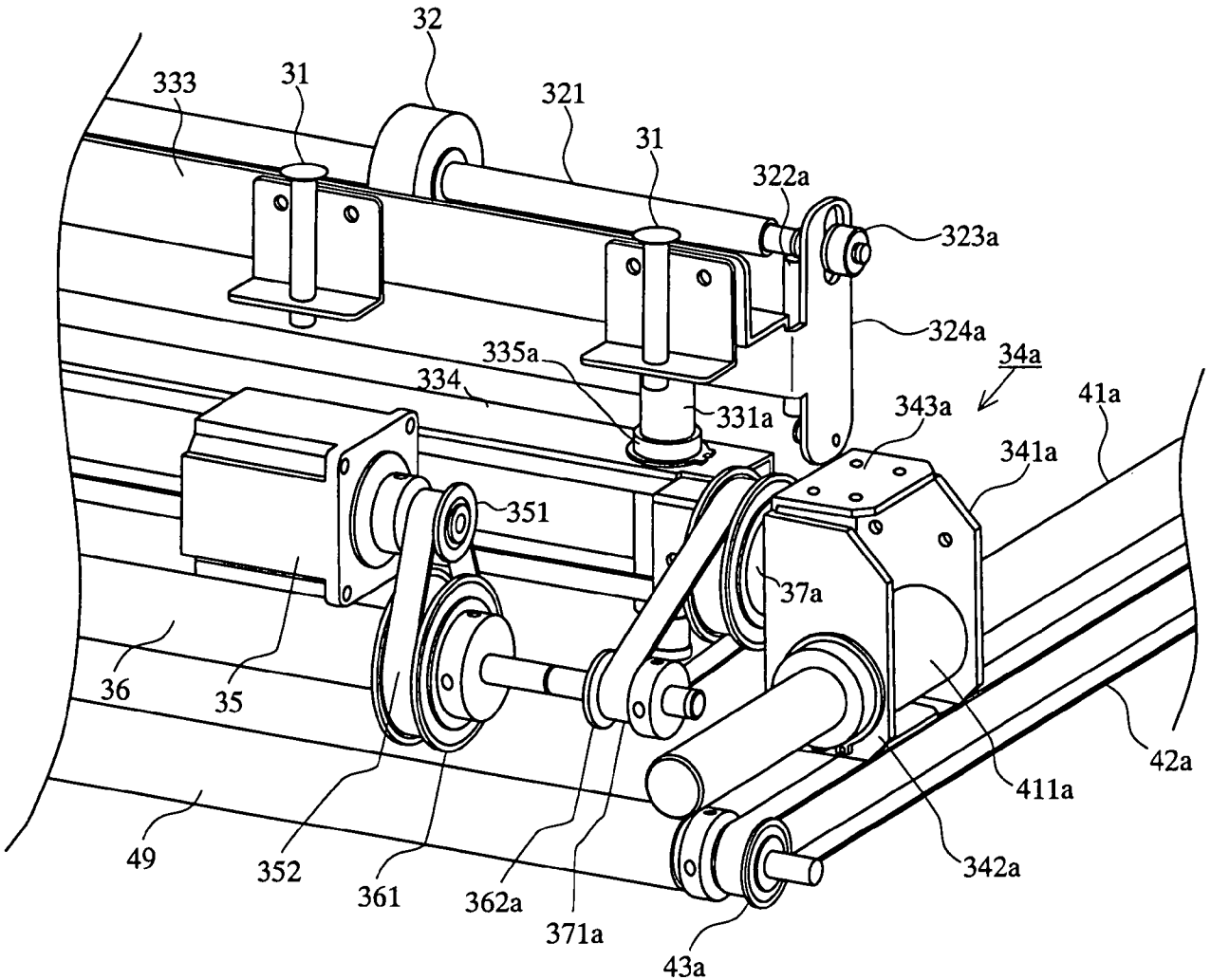
FIG. 6 is a perspective view illustrating the structure of the plate transport mechanism 3 in which a part of the linear motion base 34*a* illustrated in FIG. 3 is omitted.

Referring to FIGS. 4 to 6, the structure of the plate transport mechanism 3 is described in more detail. FIG. 4 is a side view illustrating the structure of the plate transport mechanism 3 in which a part of a back plate 345*a* composing the linear motion base 34*a* is removed and the linear motion base 34*a* is indicated by the shaded area, so as to explain the positional relationship between the linear motion base 34*a* and other elements. FIG. 5 is a side view illustrating the structure of the plate transport mechanism 3 in which the entire linear motion base 34*a* is omitted, and FIG. 6 is a perspective view illustrating the structure of the plate transport mechanism 3 in which a part of the linear motion base 34*a* is omitted. In FIGS. 4 to 6, the plate transport mechanism 3 is in a state where the support section 33 is in an upright position, and a portion composing one side of a pair of elements (i.e., the elements on the front side shown in FIG. 2) is mainly illustrated.

In FIGS. 4 and 6, the linear motion base 34*a* is constructed such that a plurality of plate-like members are joined together, and includes side plates 341*a* and 342*a*, a top plate 343*a*, a bottom plate 344*a*, and a back plate 345*a*. The coupling stay 346 having the pad rotation drive motor 35 secured thereon is coupled to the top plate 343*a* and the back plate 345*a*, whereby, as described above, the positions of the linear motion bases 34*a* and 34*b* are fixed. In FIG. 6, the coupling stay 346 and a part of the top plate 343*a*, the bottom plate 344*a*, and the back plate 345*a* are omitted. The side plates 341*a* and 342*a* have the linear shaft 41*a* passing therethrough with a linear bush 411*a* provided between the side plates. A coupling member 421*a* is screwed in the bottom plate 344*a*, and the synchronous belt 42*a* is sandwiched between the bottom plate 344*a* and the coupling member 421*a*. In this construction, when the synchronous belt 42*a* is rotated by the linear motion drive motor 45, the linear motion base 34*a* moves along the linear shaft 41*a* in accordance with the rotation of the synchronous belt 42*a*. The outer races of bearings 347*a* and 348*a* are secured on the back plate 345*a*, and the drive transmission shaft 36 and the pad rotary shaft 372*a* are secured on the inner races of the bearings 347*a* and 348*a*, respectively. This construction allows the drive transmission shaft 36 and the pad rotary shaft 372*a* to rotate about the rotation axes of the bearings 347*a* and 348*a* provided in the linear motion base 34*a*.

In FIGS. 5 and 6, the support section 33 includes pad rods 331*a* and 331*b*, compression springs 332*a* and 332*b*, a pad mounting plate 333, a pad frame 334, a Delurine shaft 321, extension springs 322*a* and 322*b*, wheels 323*a* and 323*b*, and sponge collar support plates 324*a* and 324*b*. Note that the pad rod 331*b*, the compression spring 332*b*, the extension spring 322*b*, the wheel 323*b*, and the sponge collar support plate 324*b*, which are provided on the other side of the plate transport mechanism 3, are not illustrated in the figures since they have the same structure as their counterparts illustrated on the front side in the figures.

The pad rotary shafts 372*a* and 372*b* are secured to both ends of the pad frame 334. The pad rotary shafts 372*a* and 372*b* have the drive pulleys 37*a* and 37*b* secured thereon respectively, which rotate in accordance with drive of the pad rotation drive motor 35, and thus the pad frame 334 can pivot about the pad rotary shafts 372*a* and 372*b*. The pad frame 334 has the pad rods 331*a* and 331*b* passing through side surfaces thereof around both ends via the linear bushes 335*a* and 335*b*, so as to move up and down. The pad mounting plate 333 is secured to one end of each of the pad rods 331*a* and 331*b*. Around the other end of each of the pad rods 331*a* and 331*b*, a stopper is formed to control the movement in an upward direction illustrated in FIGS. 5 and 6. The compression springs 332*a* and 332*b* are arranged between the pad mounting plate 333 and the pad frame 334 with the pad rods 331*a* and 331*b* provided to serve as shafts. By these compression springs 332*a* and 332*b*, the pad mounting plate 333 and the pad rods 331*a* and 331*b* are biased in the upward direction.

The pad mounting plate 333 has a plurality of suction pads 31 provided thereto for holding a plate P via suction. The suction pads 31 are arranged so as to be in a proper position with respect to plates P stored in the cassette 2. The suction pads 31 each have a nipple so as to be connected with a hose (not shown) which is connected so as to be in communication with a vacuum pump via an electromagnetic valve controlled by the image recording apparatus control section 83. Therefore, negative pressure is supplied to the suction pads 31 through their respective hoses, and the negative pressure is controlled by the image recording apparatus control section 83. The suction pads 31 may be caused to move in a pad-array direction (an upward-downward direction in FIG. 3A) in accordance with the size of a plate P to be held via suction by the suction pads 31. Note that in FIG. 6 the configuration of the suction pads 31 is simplified for illustration.

The sponge collar support plates 324*a* and 324*b* are securely coupled to both ends of the pad mounting plate 333. The sponge collar support plates 324*a* and 324*b* each have an opening having a substantially oval shape with its longitudinal direction extending along an upward-downward direction in FIG. 5. The Delurine shaft 321 having a plurality of sponge collars 32 provided thereto penetrates through the openings of the sponge collar support plates 324*a* and 324*b*, so as to move up and down while restricted by the shape of the openings. At both ends of the Delurine shaft 321, wheels 323*a* and 323*b* are provided so as to pivot independently of the Delurine shaft 321. The extension springs 322*a* and 322*b* are mounted between the vicinity of both ends of the Delurine shaft 321 and the sponge collar support plates 324*a* and 324*b*, and the Delurine shaft 321 is biased in a downward direction with respect to the sponge collar support plates 324*a* and 324*b*. Therefore, in a normal state, the Delurine shaft 321 is positioned at the lowest part of the openings of the sponge collar support plates 324*a* and 324*b* (i.e., the state shown in FIG. 5). In this state, the peripheral surfaces of the sponge collars 32 are positioned a predetermined distance below the suction surfaces of the suction pads 31 (i.e., on the side of the pad frame 334). In the case where the Delurine shaft 321 is positioned at the highest part of the openings (i.e., on the opposite side of the pad frame 334), the peripheral surfaces of the sponge collars 32 are positioned a predetermined distance above the suction surfaces of the suction pads 31 (i.e., on the opposite side of the pad frame 334).

In the support section 33 having such a construction, when the pad rotation drive motor 35 is driven, the pad frame 334 pivots about the pad rotary shafts 372*a* and 372*b* in accordance with drive of the pad rotation drive motor 35, and thus the two pad rods 331*a* and 331*b* passing through the pad frame 334 also pivot in phase with each other. Accordingly, the suction pads 31 and the sponge collars 32, which are connected to each other via the pad mounting plate 333 secured on the pad rods 331*a* and 331*b*, can also pivot about the pad rotary shafts 372*a* and 372*b* in phase with each other. In addition, since the pad rotary shafts 372*a* and 372*b* are provided to the linear motion bases 34*a* and 34*b*, respectively, when the linear motion drive motor 45 is driven, the suction pads 31 and the sponge collars 32 can also move in the linear motion direction or counter linear motion direction, in accordance with drive of the linear motion drive motor 45. The compression springs 332*a* and 332*b* expand and contract in accordance with a load applied by the pad mounting plate 333, and thus the pad rods 331*a* and 331*b* can move up and down in a direction in which the pad rods 331*a* and 331*b* pass through the pad frame 334, in accordance with the load. The sponge collars 32 can move up and down in accordance with the stress applied to the wheels 323*a* and 323*b*. The detailed description of the operation performed by these mechanisms during the transportation of a plate P is provided later.

Figure 7:
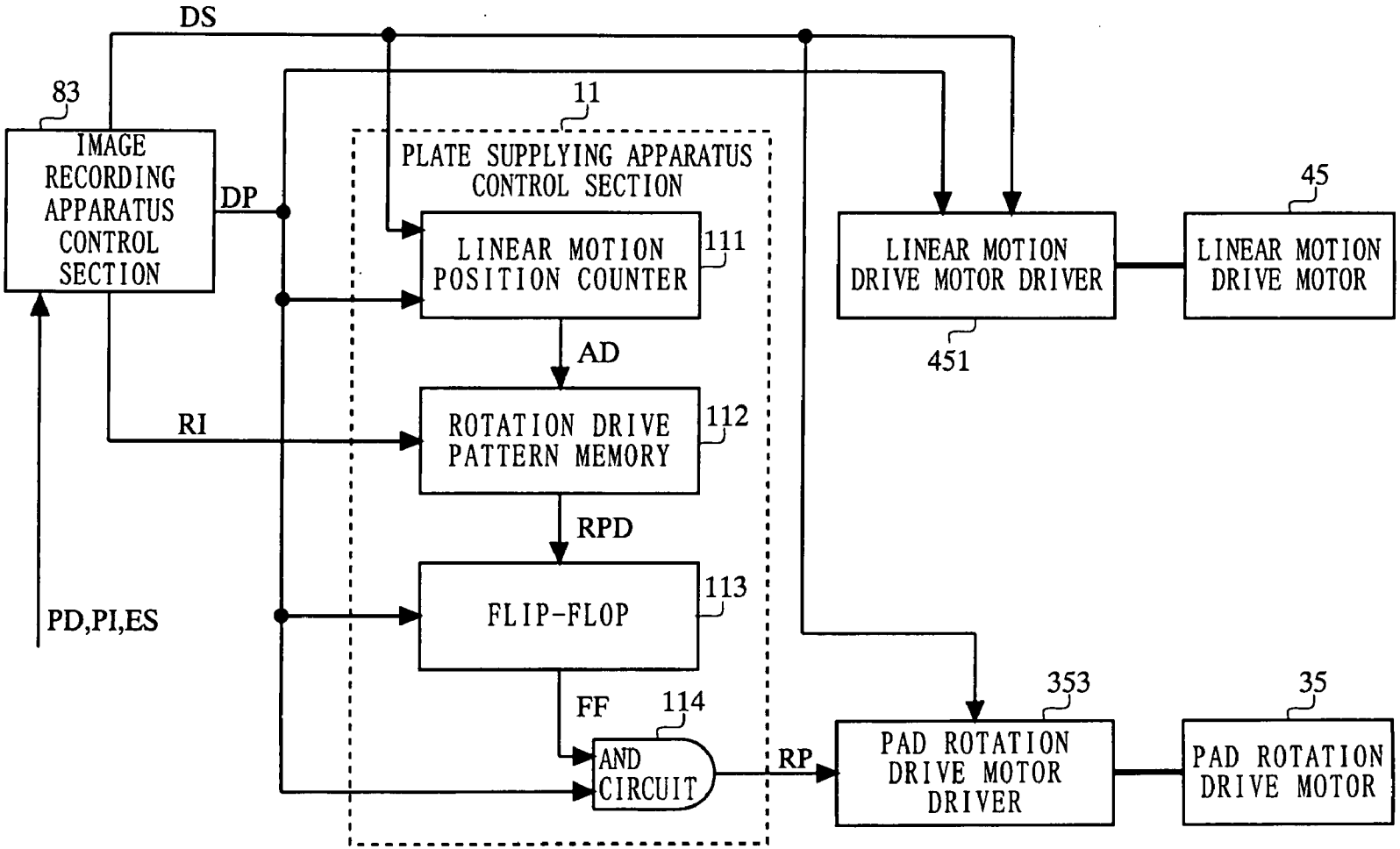
FIG. 7 is a block view illustrating the construction of a plate supplying apparatus control section 11 illustrated in FIG. 1.

Next, referring to FIG. 7, the construction of the plate supplying apparatus control section 11 is described. FIG. 7 is a block view illustrating the construction of the plate supplying apparatus control section 11.

In FIG. 7, an image recording apparatus control section 83 comprises a CPU (Central Processing Unit) and storage units, such as a ROM. To the image recording apparatus control section 83 are imputed image data PD, plate information PI, an error signal ES, etc. The image data PD is an image to be recorded on a plate P in the image recording apparatus 8, the plate information PI contains various information about the plate P (e.g., the size, thickness, and number of plates), and the error signal ES is sent from various sensors provided in the image recording apparatus 8 and the plate supplying apparatus 1. The image recording apparatus control section 83 outputs to the plate supplying apparatus 1 a linear motion drive pulse DP and a linear motion drive direction signal DS for driving the linear motion drive motor 45 and a rotation drive pattern specification signal RI for specifying a rotation drive pattern of the pad rotation drive motor 35, in accordance with the above-described inputs. The detailed description of the above processing operation is provided later.

The linear motion drive motor 45 is driven via a linear motion drive motor driver 451 in accordance with a linear motion drive pulse DP and a linear motion drive direction signal DS. The plate supplying apparatus control section 11 includes a storage unit and an electrical circuit for generating a rotation drive pulse RP for driving the pad rotation drive motor 35 in a predetermined operation pattern in accordance with a linear motion drive pulse DP and a linear motion drive direction signal DS supplied to the linear motion drive motor driver 451. The plate supplying apparatus control section 11 includes a linear motion position counter 111, a rotation drive pattern memory 112, a flip-flop 113, and an AND circuit 114.

Specifically, the linear motion position counter 111 comprises an updown counter. The linear motion position counter 111 counts pulses of the current linear motion drive in accordance with a linear motion drive pulse DP and a linear motion drive direction signal DS outputted from the image recording apparatus control section 83, and calculates, from the counting result, the current position address of the linear motion direction in the plate transport mechanism 3, and then outputs a linear motion position address signal AD. The linear motion position address signal AD indicates the position address of the plate transport mechanism 3 by, for example, a 10-bit signal.

The rotation drive pattern memory 112 is a storage unit composed of a commonly-used ROM or RAM. In the rotation drive pattern memory 112, a plurality of rotation drive pattern tables are prestored, each describing rotation drive operations in association with linear motion position addresses. FIG. 8 shows an exemplary rotation drive pattern table stored in the rotation drive pattern memory 112. The rotation drive pattern table is a data table, describing whether or not to activate the pad rotation drive motor 35 in association with all possible linear motion position addresses at which the plate transport mechanism 3 can be located, by rotation drive pattern data of 1 bit. For example, in the case where the pad rotation drive motor 35 is to be activated at a given linear motion position address, the rotation drive pattern data of "1" is assigned to the given linear motion position address. In the case where the pad rotation drive motor 35 is not to be activated at a given linear motion position address, the rotation drive pattern data "0" is assigned to the given linear motion position address. It is further defined that a rotation drive pulse (described later) will not be generated at any linear motion position address where the rotation drive pattern data reads "0", and a rotation drive pulse will be generated at any linear motion position address where the rotation drive pattern data reads "1". The rotation drive pattern memory 112 stores there in various rotation drive pattern tables which are prepared in accordance with, for example, the type (e.g., the size, thickness, and material) of a plate P to be transported, the remaining number of plates P, the transport operation, and the suction operation. These rotation drive pattern tables can be selected by a rotation drive pattern specification signal RI outputted from the image recording apparatus control section 83. On the basis of a rotation drive pattern table specified by a rotation drive pattern specification signal RI, the rotation drive pattern memory 112 outputs rotation drive pattern data RPD ("1" or "0") which is in accordance with a change in a linear motion position address signal AD. The rotation drive pattern tables stored in the rotation drive pattern memory 112 can be modified based on a user input which is made through an input device (not shown). For example, in the case of supplying a new kind of plate, a new rotation drive pattern table which conforms to such a plate can be added. In the case of changing the path along which a plate P is to be transported, the rotation drive pattern data may be updated only with respect to a given linear motion position address.

The flip-flop 113 is an electronic circuit having two stable states. The flip-flop 113 can hold information of 1 bit by associating these two states with "0" and "1". In the flip-flop 113, the two states alternate in accordance with a signal outputted from the rotation drive pattern memory 112. Therefore, if the rotation drive pattern data RPD, which is outputted from the rotation drive pattern memory 112 in synchronization with a linear motion drive pulse DP, is "1", the flip-flop 113 outputs "1" as a flip-flop signal FF, and if the rotation drive pattern data RPD is "0", the flip-flop 113 outputs "0" as a flip-flop signal FF.

Figure 9:
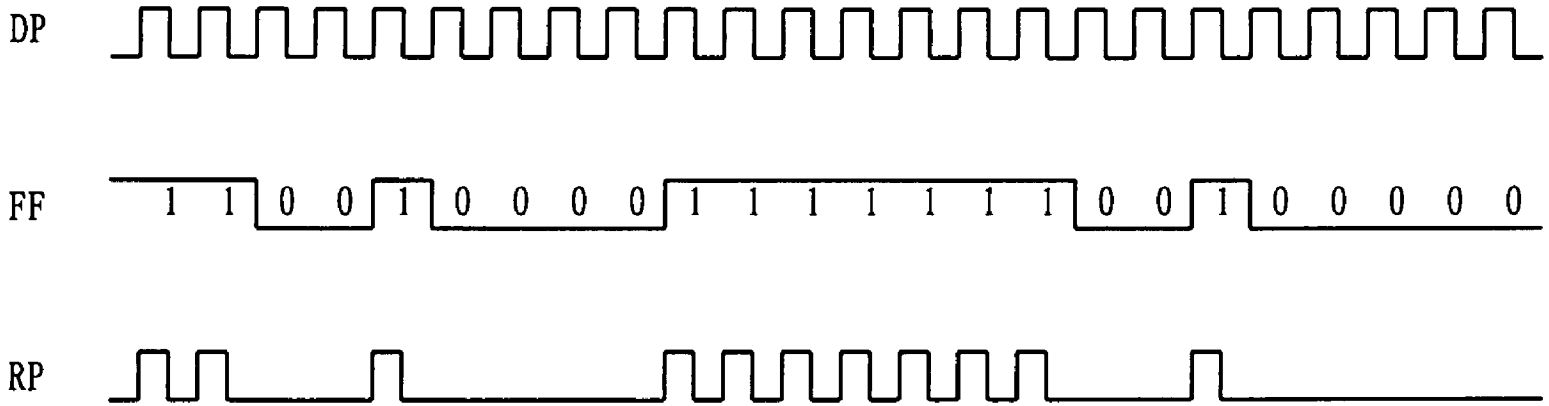
FIG. 9 is a view illustrating the relationship between a linear motion drive pulse DP, a flip-flop signal FF, and a rotation drive pulse RP illustrated in FIG. 7.

The AND circuit 114 compares a flip-flop signal FF and a linear motion drive pulse DP, and outputs "1" only when the inputs of FF and DP are both "1" (High). That is, the AND circuit 114 outputs only those linear motion drive pulses DP at which the flip-flop signal FF is "1", while removing those linear motion drive pulses DP at which the flip-flop signal FF is "0". FIG. 9 is a view illustrating the relationship between the linear motion drive pulse DP, the flip-flop signal FF, and the rotation drive pulse RP outputted from the AND circuit 114. As illustrated in FIG. 9, the rotation drive pulses RP outputted from the AND circuit 114 are composed of only those linear motion drive pulses DP at which the flip-flop signal FF is "1". The flip-flop signal FF is "1" when the pad rotation drive motor 35 is to be activated at a linear motion position address. That is, the rotation drive pulse RP is a signal for activating the pad rotation drive motor 35 in accordance with a linear motion position address of the plate transport mechanism 3, and is generated in accordance with a selected rotation drive pattern table.

The pad rotation drive motor 35 is driven via the pad rotation drive motor driver 353 in accordance with a linear motion drive direction signal DS and a rotation drive pulse RP outputted from the AND circuit 114.

Figure 10:
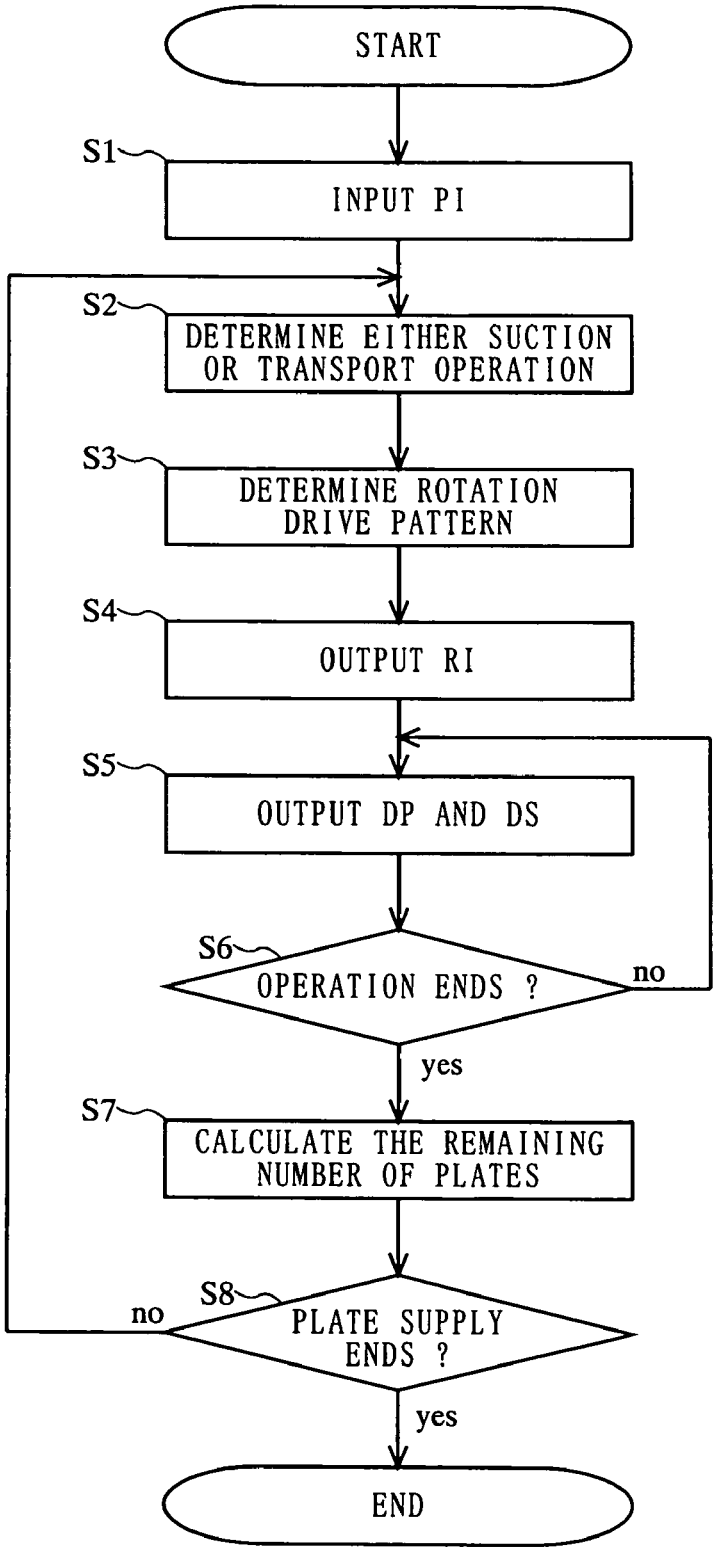
FIG. 10 is a flowchart illustrating a control operation performed by an image recording apparatus control section 83 illustrated in FIG. 1.

Next, referring to FIG. 10, the process of controlling the operation of the plate supplying apparatus 1 by the image recording apparatus control section 83 is described. FIG. 10 is a flowchart illustrating the control operation performed by the image recording apparatus control section 83.

In FIG. 10, the image recording apparatus control section 83 obtains plate information PI about a plate P by input from the user, etc. (step S1). The plate information PI contains information, such as the size (length, width, thickness, etc.) and type (a material, a plate manufacturer's name, etc.) of plates P stored in the cassette 2 of the plate supplying apparatus 1 and the number of plates P initially stored in the cassette 2.

Then, the image recording apparatus control section 83 determines either a suction operation where a plate P stored in the cassette 2 is sucked by the plate supplying apparatus 1 or a transport operation where a sucked plate P is transported toward the transport rollers 51 and 52 by the plate supplying apparatus 1 (step S2). Typically, the suction operation is an operation in the counter linear motion direction where the plate transport mechanism 3 in state B, shown in FIG. 2, is moved to the position shown in state A, and the transport operation is an operation in the linear motion direction where the plate transport mechanism 3 in state A, shown in FIG. 2, is move to the position shown in state B.

Subsequently, the image recording apparatus control section 83 determines a rotation drive pattern for pivoting the support section 33 in accordance with a linear motion position address of the plate transport mechanism 3 (step S3). Upon determination of the rotation drive pattern, the image recording apparatus control section 83 selects a rotation drive pattern with which the suction pads 31 move along an optimum path, in accordance with the plate information PI obtained in step S1, the operating direction determined in step S2, and the current remaining number of plates P stored in the cassette 2 (the number of plates P supplied to the cassette 2 or the remaining number of plates P to be calculated in step S7, which will be described later).

Figure 11:
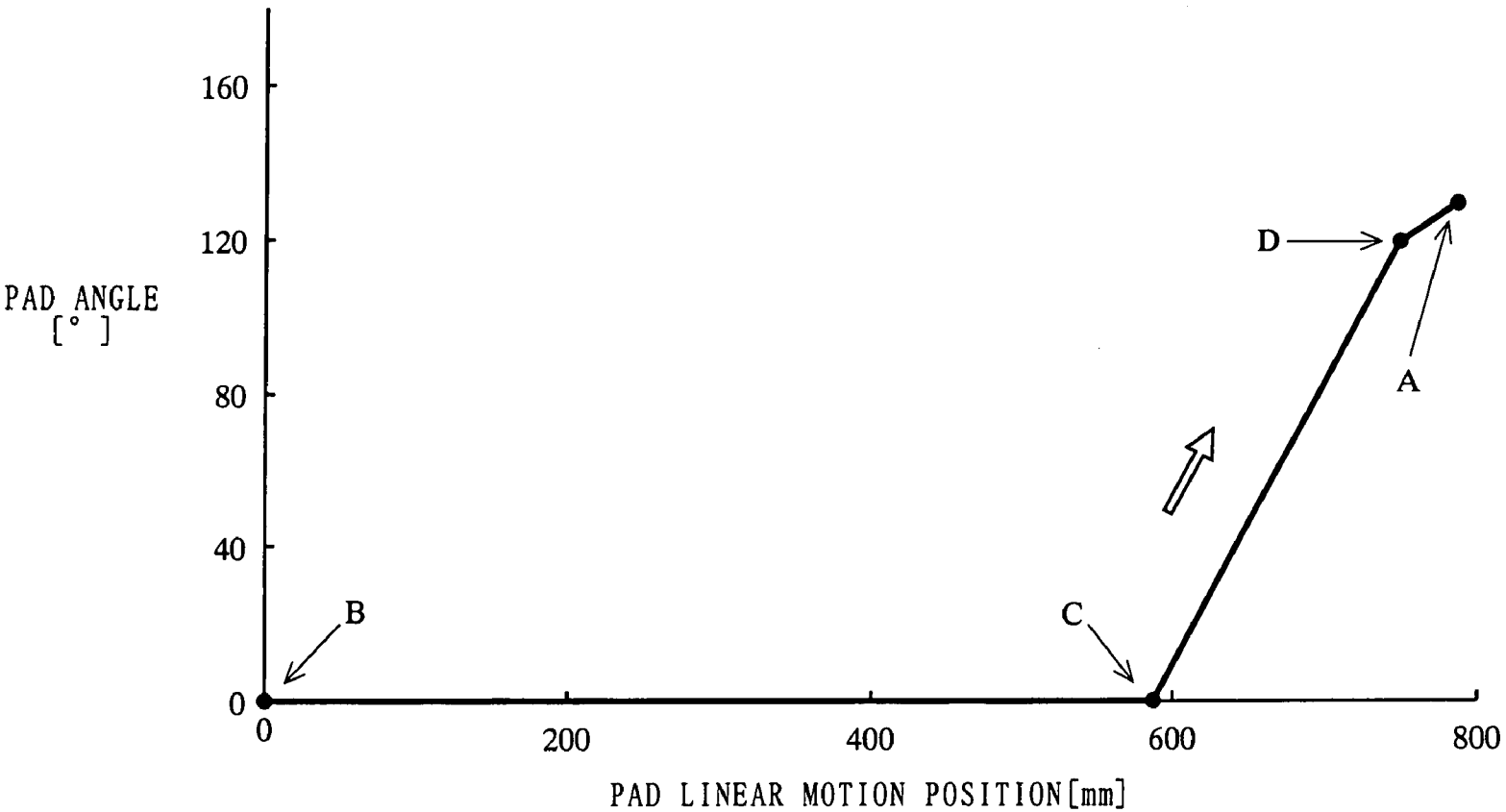
FIG. 11 is an exemplary graph of a rotation drive pattern for the case where the plate transport mechanism 3 illustrated in FIG. 2 performs a suction operation.
Figure 12:
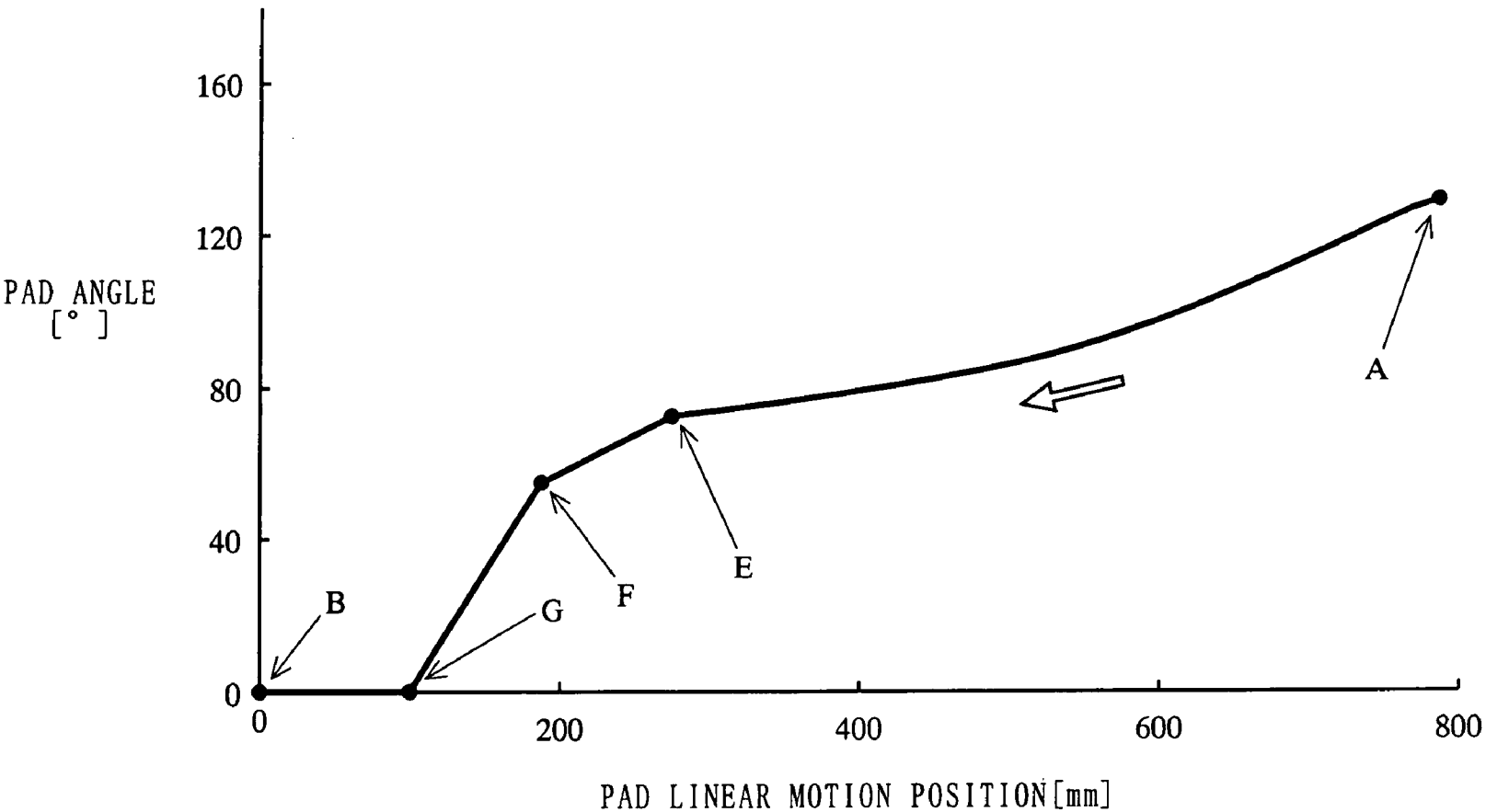
FIG. 12 is an exemplary graph of a rotation drive pattern for the case where the plate transport mechanism 3 illustrated in FIG. 2 performs a transport operation.

Referring to FIGS. 11 and 12, exemplary rotation drive patterns are described. FIG. 11 shows an exemplary rotation drive pattern for the case where the plate transport mechanism 3 performs the suction operation, and FIG. 12 shows an exemplary rotation drive pattern for the case where the plate transport mechanism 3 performs the transport operation. FIGS. 11 and 12 are graphs showing the relationship between a rotation drive pattern for the suction operation and a rotation drive pattern for the transport operation, where the horizontal axis represents the pad linear motion position (mm) which indicates the position of the plate transport mechanism 3 in the linear motion direction or counter linear motion direction, and the vertical axis represents the pad angle (°) which indicates the pivot angle of the support section 33. In FIGS. 11 and 12, the position of the plate transport mechanism 3 in state B shown in FIG. 2 is regarded as the initial position (where the pad linear motion position is 0 mm and the pad angle is 0°), and the angle increases as the support section 33 in state B pivots in a clockwise direction.

In FIG. 11, the suction operation is performed as follows. First, the plate transport mechanism 3 in state B moves in the counter linear motion direction without pivoting the support section 33 (state B→state C). Next, the plate transport mechanism 3 in state C further moves in the counter linear motion direction, and then the support section 33 pivots in the clockwise direction until it approximates the suction angle of a plate P, thus entering a preparatory stage (state C→state D). Then, the plate transport mechanism 3 in state D performs a suction operation on the plate P stored in the cassette 2, and the support section 33 further pivots in the clockwise direction while the plate transport mechanism 3 moves in the counter linear motion direction, without allowing the position of the suction pads 31, which is now in contact with the neighborhood of an end of the plate P, to move with respect to the plate P (state D→state A).

In FIG. 12, the transport operation is performed as follows. First, the support section 33 pivots in the transport rotation direction while moving in the linear motion direction, such that the plate P is removed from the cassette 2 without allowing the other end of the plate P to move with respect to another plate P stored in the cassette 2, thus preventing friction between the plate P being taken out and the another plate P stored in the cassette 2 (state A→state E). The suction pads 31 in state A→state E move so as to follow an optimum path which varies, for example, with the size, thickness, and remaining number of plates P to be transported.

The optimum path along which the suction pads 31 move is described. When the plate transport mechanism 3 takes out a plate P from the cassette 2, friction occurring between the plate P to be taken out and another plate needs to be prevented. For this purpose, the upper end of the plate P to be transported will follow a line slightly below at least the reference path, where the reference path is defined as an arc of a circle (for example, arcs R1 and R2 shown in FIG. 18) whose radius is the length of a plate stored in the cassette 2 and whose center is the lower end of the plate. If the upper end of the plate P follows a line above the reference path, the plate P will be dragged upwards, thus causing friction between the plate P and another plate.

The optimum amount of downward deviation from the reference path varies with the linear motion position of the plate transport mechanism 3. For example, in the state where an end of a plate P has just been lifted off other plates stored in the cassette 2, it is preferable that the amount of downward deviation be greater than that in other linear motion positions. This realizes a so-called "separation operation" for shaking off any plates adhered to the image recording layer side of the plate P to be transported, by slightly pushing down and bending the plate P to be taken out.

In addition, the optimum amount of downward deviation varies with the flexibility (stiffness) of the plate P to be transported. The stiffness of a plate is determined by the thickness, material, etc., of the plate. In the case where a plate P with high stiffness is to be taken out from the cassette 2, if the amount of downward deviation is too large, the reaction force that causes the plate P to return to its flat state may become greater than the suction force of the suction pads 31, causing the suction pads 31 to be detached from the plate P. The optimum path to be set in the plate supplying apparatus 1 is obtained by setting an appropriate amount of deviation from the reference path as described above, in accordance with the plate to be transported.

Figure 18:
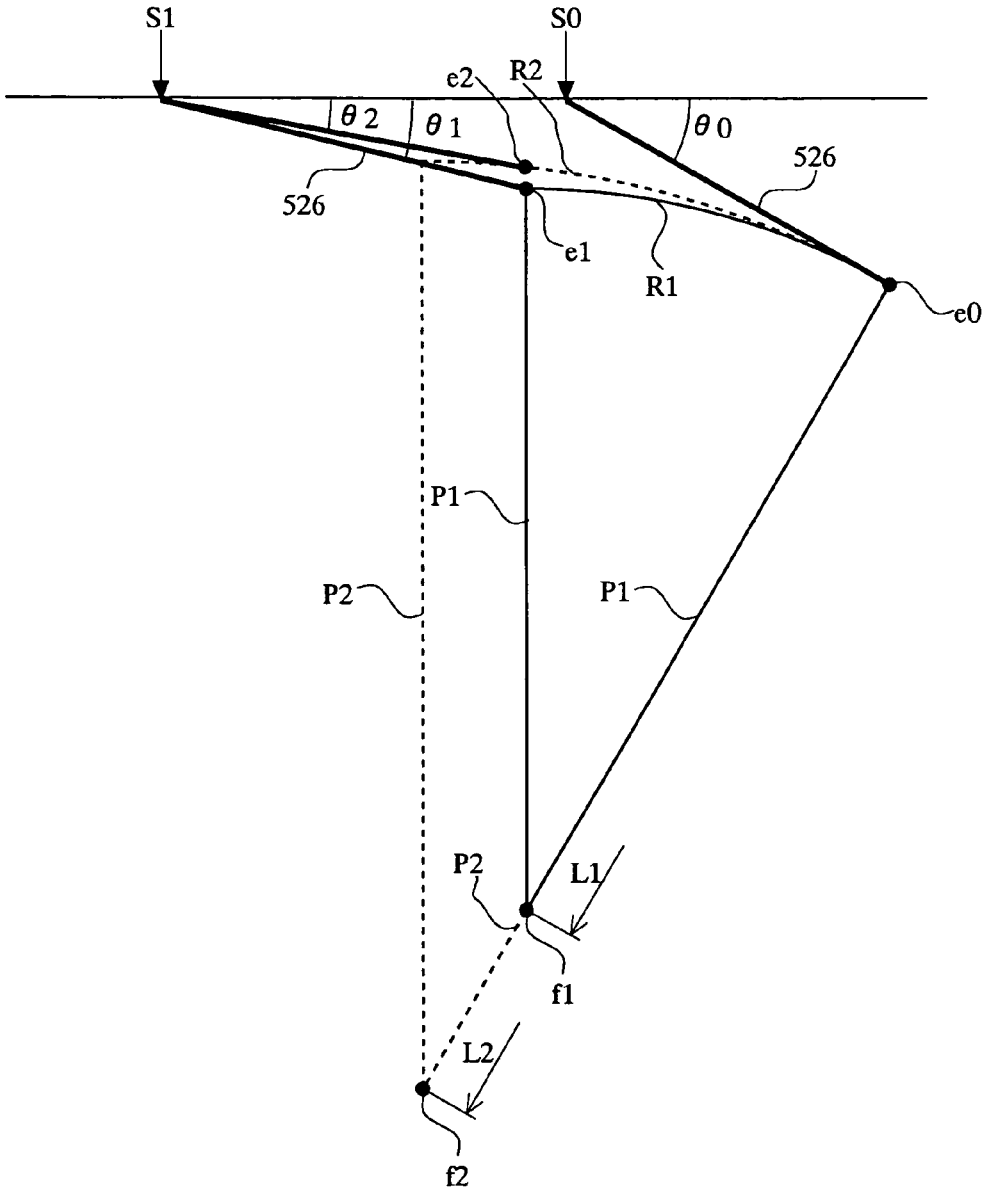
FIG. 18 is a view used for explaining a reference path for transporting a plate P.

Now, an example is described in which the optimum path is controlled in accordance with the length of the plate P, with respect to the case of transporting plates P1 and P2, shown in FIG. 18. For simplicity of description, it is assumed that the upper end of a plate P to be transported follows the above-described reference path.

The plate P1 with length L1 is taken out from the cassette 2 by the plate transport mechanism 3 such that the upper end of the plate P1 follows an arc R1. The suction pads 31 suck the upper end of the plate P1 stored in the cassette 2 at a point e0. Although the illustration of FIG. 18 is simplified so that the suction pads 31 appear to be sucking at the upper end of the plate P1, the suction pads 31 will suck somewhat below the upper end in practice. In this state, the plate transport mechanism 3 is positioned at a linear motion position S0, and the support section 33 makes an angle θ0 with respect to the linear motion direction. Then, the plate transport mechanism 3 moves to a linear motion position S1, and the upper end of the plate P1 moves from the point e0 to a point e1. At this point, the support section 33 makes an angle θ1 with respect to the linear motion direction.

The plate P2 with length L2 is taken out from the cassette 2 by the plate transport mechanism 3 such that the upper end of the plate P2 follows an arc R2. The suction pads 31 suck the upper end of the plate P2 stored in the cassette 2 at the point e0. In this state, the plate transport mechanism 3 is positioned at the linear motion position S0, and the support section 33 makes an angle θ0 with respect to the linear motion direction. Then, the plate transport mechanism 3 moves to the linear motion position S1. Since the plate P2 is taken out in such a manner that the upper end of the plate P2 follows the arc R2, the upper end of the plate P2 moves from the point e0 to a point e2. At this point, the support section 33 makes an angle θ2 with respect to the linear motion direction. That is, when the plate transport mechanism 3 is moved to the linear motion position S1, the angle θ2 of the support section 33 for the case of transporting the plate P2 is different from the angle θ1 of the support section 33 for the case of transporting the plate P1. By thus controlling the operation of the plate transport mechanism 3 in the linear motion direction and the angle of the support section 33 in accordance with the length of plate P, the path that the upper end of a plate P follows is changed.

Next, the support section 33 pivots in the transport rotation direction while the plate transport mechanism 3 in state E further moves in the linear motion direction, whereby the pad angle of the support section 33 becomes 0° (state E→state F→state G). When the plate transport mechanism 3 in state E moves to the position shown in state F, the plate P sucked by the suction pads 31 is fully lifted off the cassette 2. Then, when the plate transport mechanism 3 is moved to the position shown in state G, the support section 33 pivots so as to take an upright position (i.e., the suction surfaces of the suction pads 31 face upward). Subsequently, the plate transport mechanism 3 in state G moves in the linear motion direction without pivoting the support section 33, and then in state B the end of the plate P is sandwiched between the transport rollers 51 and 52 (state G→state B).

Such rotation drive patterns are predetermined in accordance with, for example, the size (length, width, thickness, etc.) and type (a material, a plate manufacturer's name, etc.) of a plate P, the operating direction of the plate transport mechanism 3, and the currently remaining number of plates P in the cassette 2, so that the suction pads move along respective optimum paths. The image recording apparatus control section 83 selects, in step S3, an optimum rotation drive pattern from various rotation drive patterns, in accordance with the plate information PI, the operating direction, and the remaining number of plates P. As described above, rotation drive pattern tables (see FIG. 8) which contain these rotation drive patterns are prestored in the rotation drive pattern memory 112.

Referring back to FIG. 10, the image recording apparatus control section 83 outputs a rotation drive pattern specification signal RI to the rotation drive pattern memory 112 so as to notify the rotation drive pattern table containing the rotation drive patterns, as determined in step S3, to the plate supplying apparatus 1 (step S4). In response to the rotation drive pattern specification signal RI output in step S4, a rotation drive pattern table used by the rotation drive pattern memory 112 is selected, as described above.

Next, the image recording apparatus control section 83 outputs a linear motion drive pulse DP and a linear motion drive direction signal DS for driving the linear motion drive motor 45, to the linear motion drive motor driver 451 and the plate supplying apparatus control section 11, and also outputs the linear motion drive direction signal DS to the pad rotation drive motor driver 353 (step S5). The image recording apparatus control section 83 outputs a linear motion drive direction signal DS in accordance with the operation determined in step S2. In the case of the suction operation, the image recording apparatus control section 83 starts to supply a predetermined level of negative pressure to the suction pads 31 from a predetermined linear motion position, by controlling the above-described negative pressure pump and electromagnetic valve (for example, the supply of negative pressure starts in state D).

As described above, in response to the linear motion drive pulse DP and the linear motion drive direction signal DS outputted to the plate supplying apparatus control section 11, a rotation drive pulse RP which synchronizes with the linear motion drive pulse DP is generated in the plate supplying apparatus control section 11 in accordance with a rotation drive pattern determined in step S3, and then the rotation drive pulse RP is outputted to the pad rotation drive motor driver 353. Therefore, the linear motion drive motor 45 is driven by the control of the image recording apparatus control section 83, and the pad rotation drive motor 35 is driven in accordance with a rotation drive pattern selected in synchronization with the linear motion drive pulse DP.

The image recording apparatus control section 83 then determines whether the plate transport mechanism 3, whose operation is currently controlled by the image recording apparatus control section 83, has reached the end of the operation (step S6). This determination may be made in such a manner that the image recording apparatus control section 83 calculates the current linear motion position address by counting linear motion drive pulses DP and then compares between the current linear motion position address and a linear motion position address set as the end address. Alternatively, position sensors (not shown) for detecting that the plate transport mechanism 3 has reached the end position of the linear motion direction and the end position of the counter linear motion direction may be provided in the plate supplying apparatus 1 so as to make such a determination in accordance with the outputs from the position sensors. If the image recording apparatus control section 83 determines that the plate transport mechanism 3 has reached the end of the operation, processing advances to the next step S7. In the case of the transport operation, the image recording apparatus control section 83 terminates the supply of negative pressure to the suction pads 31 by controlling the negative pressure pump and the electromagnetic valve. On the other hand, if the image recording apparatus control section 83 determines that the plate transport mechanism 3 has not reached the end of the operation, processing continues with step S5.

Instep S7, the image recording apparatus control section 83 calculates the remaining number of plates in the cassette 2 placed in the plate supply position of the plate supplying apparatus 1. Specifically, the calculation is performed by subtracting the number of operation processes performed by the image recording apparatus control section 83 (i.e., the number of plates P that have been supplied to the image recording apparatus 8) from the number of plates initially supplied, which is indicated by the plate information PI obtained by the image recording apparatus control section 83 in step S1.

Then, the image recording apparatus control section 83 determines whether or not to end the supply of a plate P from the plate supplying apparatus 1 to the image recording apparatus 8 (step S8). If the image recording apparatus control section 83 determines that the supply of a plate P is to be continued, processing returns to and continues with step S2. If the image recording apparatus control section 83 determines to end the supply of a plate P, the processing according to this flowchart ends.

As described above, the plate supplying apparatus control section 11 can pivot the support section 33 in a predetermined rotation drive pattern and in conjunction with the linear motion operation of the plate transport mechanism 3, without the need to specify the rotation position of the support section 33. In the image recording apparatus control section 83 too, the rotation can be controlled only by controlling a drive pulse in the linear motion direction and the counter linear motion direction, without the need to specify the rotation position of the support section 33.

Figure 13:
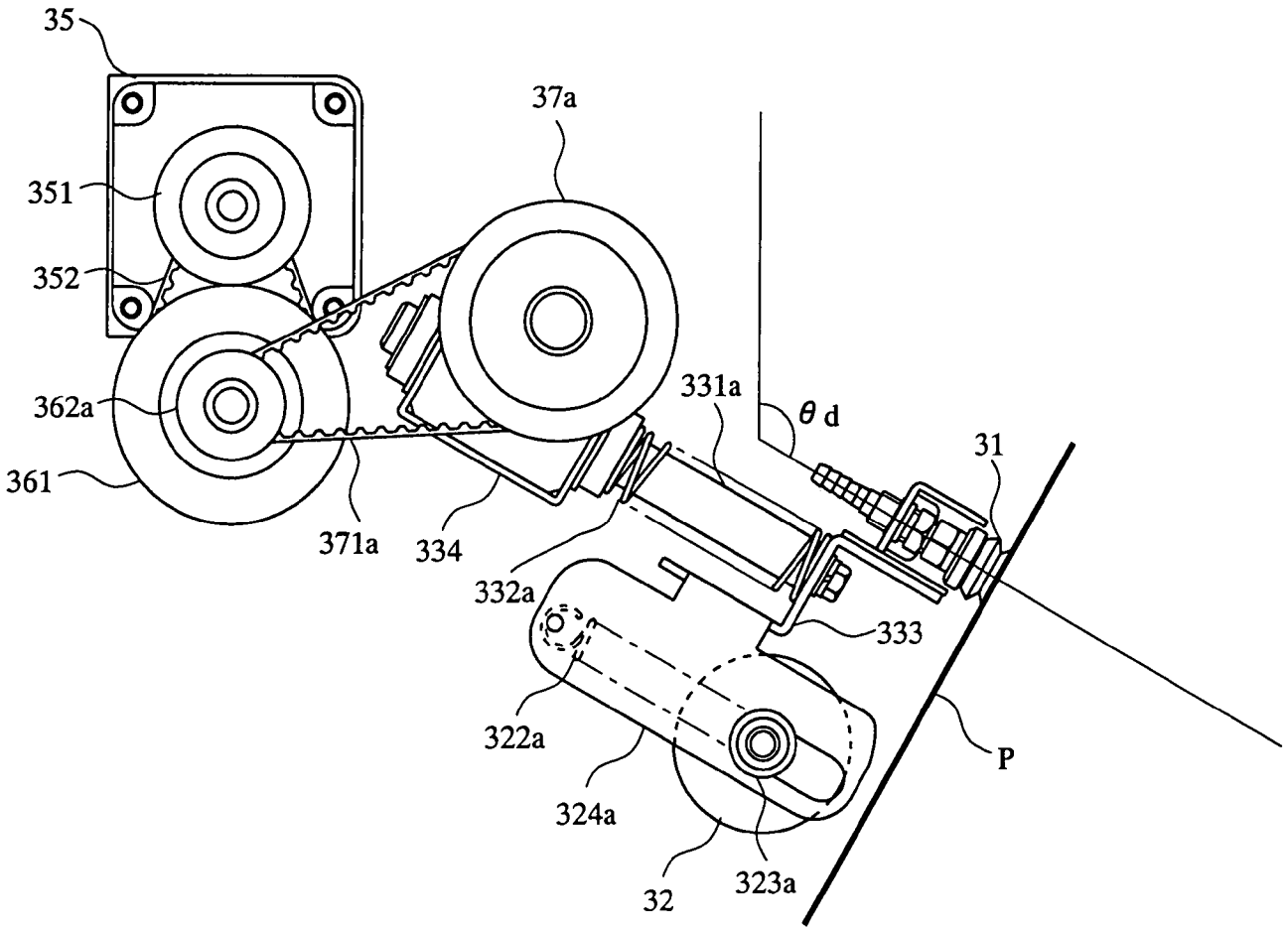
FIG. 13 is a side view illustrating a state where the plate transport mechanism 3 sucks a plate P stored in a cassette 2 illustrated in FIG. 2.
Figure 14:
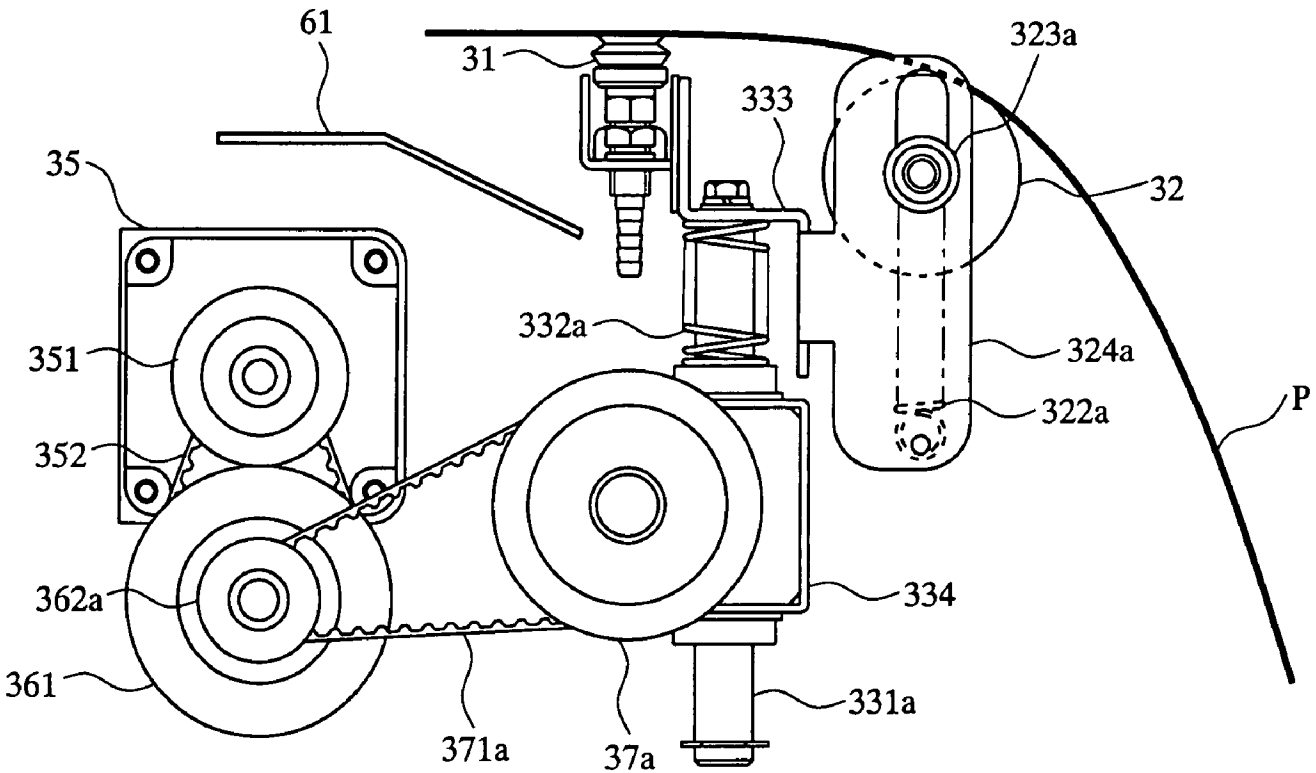
FIG. 14 is a side view illustrating a state of the plate transport mechanism 3 where suction pads 31 illustrated in FIG. 13 hold the plate P via suction and the suction surfaces of the suction pads 31 face upward.
Figure 15:
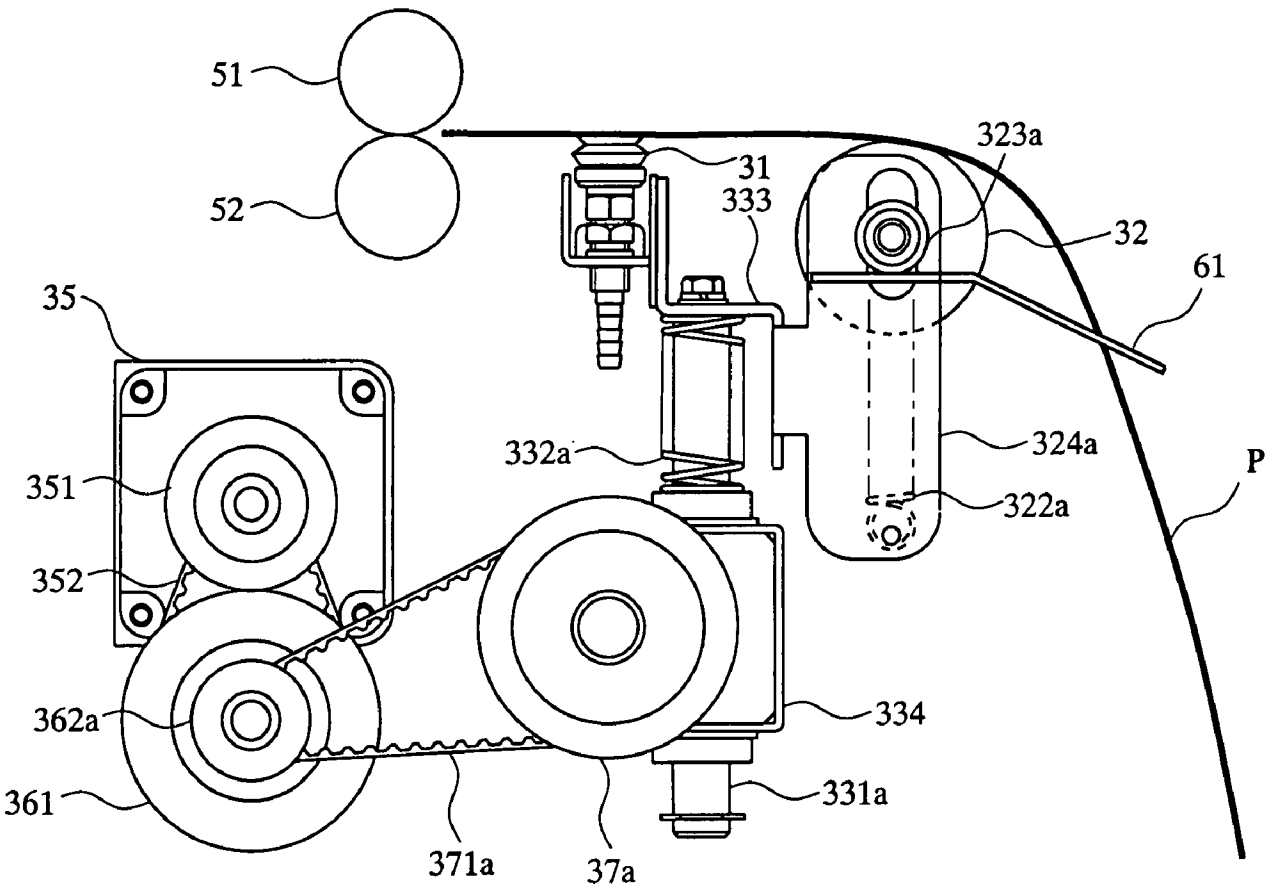
FIG. 15 is a side view illustrating a state of the plate transport mechanism 3 where sponge collars 32 illustrated in FIG. 14 are guided by sponge collar guide rails 61.
Figure 16:
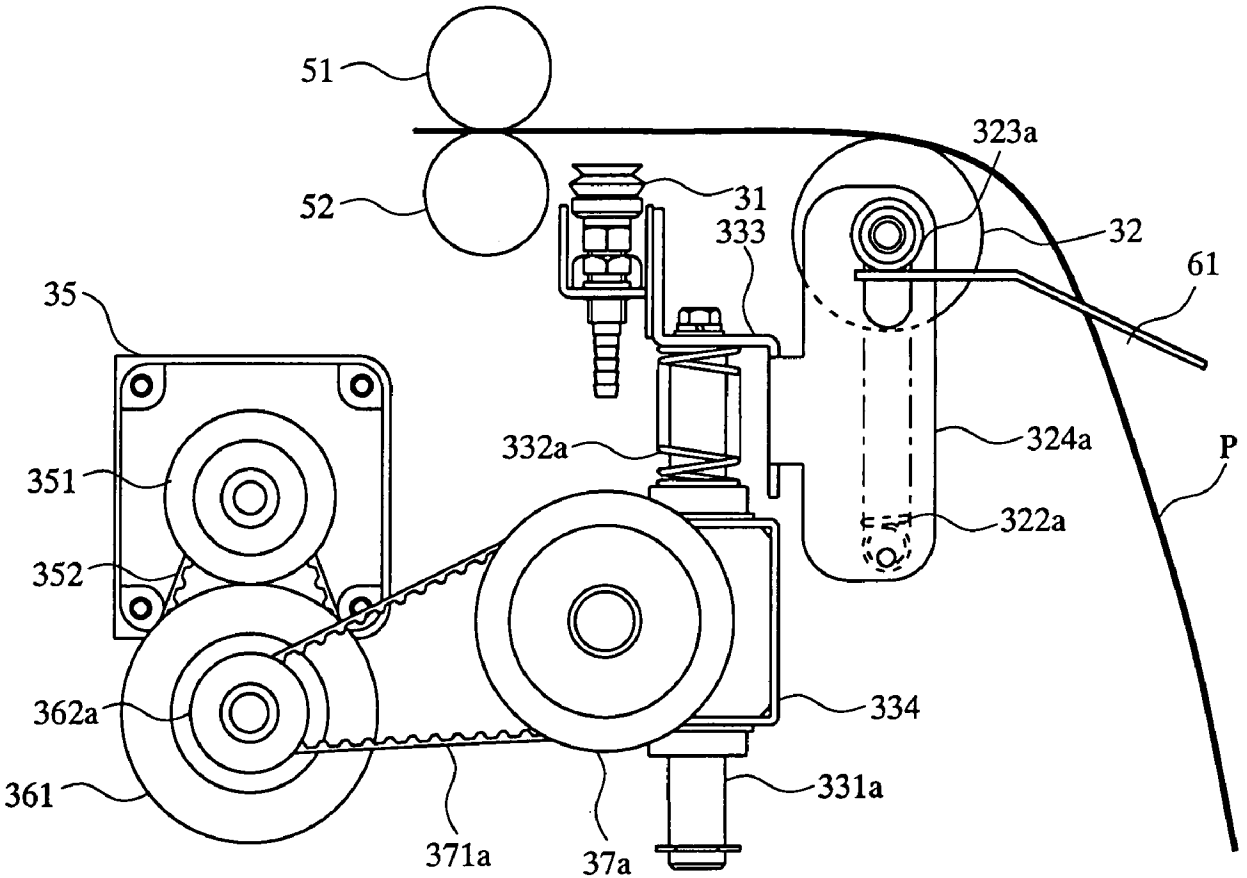
FIG. 16 is a side view illustrating a state of the plate transport mechanism 3 where the plate P illustrated in FIG. 15 is sandwiched between transport rollers 51 and 52 and the supply of negative pressure to the suction pads 31 is terminated.
Figure 17:
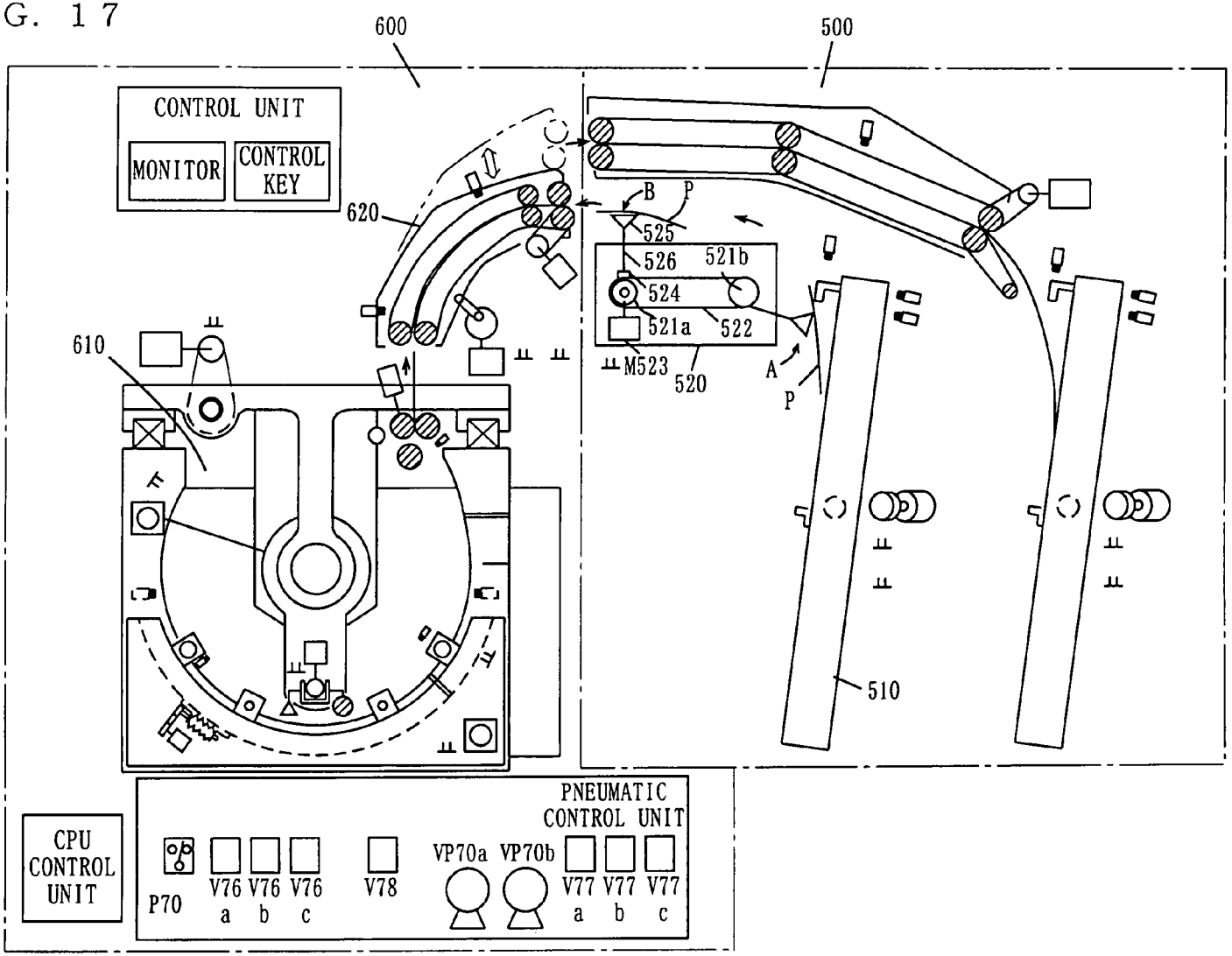
FIG. 17 is a schematic view illustrating the construction of conventional plate supplying apparatus 500 and image recording apparatus 600.

Referring to FIGS. 13 to 16, the operation of the suction pads 31, sponge collars 32, and support section 33 of the plate transport mechanism 3 during the transport operation is described. FIG. 13 is a side view illustrating a state where the plate transport mechanism 3 sucks a plate P stored in the cassette 2; FIG. 14 is a side view illustrating a state of the plate transport mechanism 3 where the suction pads 31 hold the plate P via suction and the suction surfaces of the suction pads 31 face upward; FIG. 15 is a side view illustrating a state of the plate transport mechanism 3 where sponge collars 32 in the state illustrated in FIG. 14 are guided by sponge collar guide rails 61; and FIG. 16 is a side view illustrating a state of the plate transport mechanism 3 where the plate P in the state illustrated in FIG. 15 is sandwiched between the transport rollers 51 and 52 and the supply of negative pressure to the suction pads 31 is terminated. In FIGS. 13 to 16, for simplicity of description, the linear motion drive mechanism 4 and the linear motion base 34 are omitted and only those elements on one side (i.e., the elements on the front side shown in FIG. 2) are illustrated.

In FIG. 13, in the plate transport mechanism 3, the pivot angle of the support section 33 is controlled such that the suction pads 31 are vertical to the plate P stored in the cassette 2, and the suction pads 31 hold via suction around an end portion of the support layer side of the plate P. Here, the angle at which the suction surfaces of the suction pads 31 face upward and at which the support section 33 is in an upright position, is 0°, and the angle of the suction pads 31 shown in FIG. 13 is θd. Since the plate P is being stored in the cassette 2, θd>90°. At this point, the total weight of the suction pads 31, the pad rods 331, the pad mounting plate 333, and the sponge collar support plate 324 (hereinafter referred to as the "pad weight Wpd"), the total weight of the sponge collars 32, the Delurine shaft 321, the wheels 323 (hereinafter referred to as the "sponge collar weight Ws"), and the total weight W322 of the extension springs 322 are all applied in a direction such that the pad rods 331*a* and 331*b* move toward the plate P side with respect to the pad frame 334 (hereinafter referred to as the "expansion direction", and the opposite direction is hereinafter referred to as the "contraction direction"). In addition, the combined elastic force of the compression springs 332*a* and 332*b* (hereinafter referred to as the "pressing force F332") also acts in the expansion direction, and thus the pad rods 331*a* and 331*b* move to a point where the stoppers formed on the other side of the pad rods 331*a* and 331*b* and the pad frame 334 contact with each other.

To the extension springs 322*a* and 322*b*, the sponge collar weight Ws is applied in the expansion direction. However, by setting the combined tension of the extension springs 322*a* and 322*b* (hereinafter referred to as the "tension F322") as follows:

$$F322 > Ws \cdot \sin(\theta d - 90°) \quad (1),$$

the sponge collars 32 are placed in the openings of the sponge collar support plates 324*a* and 324*b* on the opposite side of the plate P.

By the operation of the support section 33 described above, when the plate transport mechanism 3 starts to perform a suction operation on a plate P stored in the cassette 2, first the suction surfaces of the suction pads 31 contact with the plate P, and thus stable contact and suction operations can be performed on the plate P. In addition, in the case where the plate transport mechanism 3 further moves in the counter linear motion direction after the suction pads 31 have contacted with the plate P, the compression springs 332*a* and 322*b* are compressed, whereby the force given to the plate P can be reduced.

In FIG. 14, in the case where the suction surfaces of the suction pads 31 face upward with the suction pads 31 holding the plate P via suction (i.e., the angle of the suction pads 31 is 0°), the plate P is bent because of its own weight, and thus the plate P is supported by the suction surfaces of the suction pads 31 and the peripheral surfaces of the sponge collars 32. At this point, the pad weight Wpd, the sponge collar weight Ws, the weight W322 of the extension springs 322, and the weight Wp of the plate P are all applied as the force in the contraction direction of the pad rods 331*a* and 331*b*. On the other hand, the pressing force F332 of the compression springs 332 acts in the expansion direction. Therefore, the pad rods 331*a* and 331*b* keep moving in the contraction direction until they reach a point where their respective weights and pressing forces are balanced, i.e., a point that satisfies the following relationship:

$$F332=Wpd+Ws+W332+Wp \quad (2).$$

To the extension springs 322*a* and 322*b*, a part of the sponge collar weight Ws and a part of the weight Wp of the plate P are further applied in the contraction direction. Therefore, the sponge collars 32 are placed in the openings of the sponge collar support plates 324*a* and 324*b* on the opposite side of the plate P.

In FIG. 15, when the plate transport mechanism 3 in the state shown in FIG. 14 moves in the linear motion direction at a constant angle of the support section 33, the wheels 323*a* and 323*b* are guided along a pair of sponge collar guide rails 61 secured on the side surfaces of the main unit of the plate supplying apparatus 1, whereby the wheels 323*a* and 323*b* in the state shown in FIG. 14 move in an upward direction (i.e., a direction outward from the pad frame 334) along the openings of the sponge collar support plates 324*a* and 324*b*. By the movement of the wheels 323*a* and 323*b*, the Delurine shaft 321 having the wheels 323*a* and 323*b* provided thereto also move in the upward direction. Accordingly, a plurality of the sponge collars 32 provided to the Delurine shaft 321 move in the upward direction. Here, the weight Wp of the plate P is received by a pair of the sponge collar guide rails 61 via the sponge collars 32, the Delurine shaft 321, and the wheels 323*a* and 323*b*. The tension F322 of the extension springs 322*a* and 322*b* acts in the expansion direction of the pad rods 331*a* and 331*b*. Further, the total force (hereinafter referred to as the "plate reaction force Fp"), which includes the self-weight of the plate P and the force that causes the bent plate P to return to its flat state, acts on the suction surfaces of the suction pads 31 in the expansion direction of the pad rods 331*a* and 331*b*. Therefore, the pad rods 331*a* and 331*b* in the state shown in FIG. 14 keep moving in the expansion direction until they reach a point where their respective weights and forces are balanced, i.e., a point that satisfies the following relationship:

$$F332+F322=Wpd-Fp \quad (3).$$

Here, it is preferable to set the pressing force F332 of the compression springs 332, the tension F322 of the extension springs 322, the position of the sponge collar guide rails 61, and the related dimensions of the support section 33 such that the Delurine shaft 321 is placed in the middle position of the openings of the sponge collar support plates 324*a* and 324*b*.

In FIG. 16, when the plate transport mechanism 3 in the state shown in FIG. 15 further moves in the linear motion direction at a constant angle of the support section 33, and the wheels 323*a* and 323*b* move by the guide of a horizontal portion of the sponge collar guide rails 61, an end of the plate P is sandwiched between the transport rollers 51 and 52. Then, under the control of the image recording apparatus control section 83, the supply of negative pressure to the suction pads 31 is terminated. Here, the weight Wp of the plate P is received by the transport rollers 51 and 52 and a pair of the sponge collar guide rails 61 via the sponge collars 32, the Delurine shaft 321, and the wheels 323*a* and 323*b*. The plate reaction force Fp of the plate P does not act on the pad rods 331*a* and 331*b* because the suction pads 31 do not suck the plate P. On the other hand, the tension F322 of the extension springs 322*a* and 322*b* acts in the expansion direction of the pad rods 331*a* and 331*b*. Therefore, the pad rods 331*a* and 331*b* keep moving until they reach a point where their respective weights and forces are balanced, i.e., a point that satisfies the following relationship:

$$F332+F322=Wpd \quad (4).$$

Here, since the plate reaction force Fp does not act on the pad rods 331*a* and 331*b* to move them in the expansion direction, the pad rods 331*a* and 331*b* in the state shown in FIG. 15 move in the contraction direction. That is, although the Delurine shaft 321 attached to the wheels 323*a* and 323*b* and the sponge collars 32 are continuously in the state of being guided by the sponge collar guide rails 61, other members (i.e., the suction pads 31, the pad rods 331, the pad mounting plate 333, and the sponge collar support plate 324) move in the contraction direction. Thus, the suction surfaces of the suction pads 31 are detached from the plate P when the supply of negative pressure is terminated. Accordingly, when the transport rollers 51 and 52 transport the plate P to the image recording apparatus 8, it is possible to prevent the plate P from contacting with the suction surfaces of the suction pads 31. In addition, the above-described operation of the support section 33 can be easily realized by adjusting the spring moduli and dimensions of the compression springs 332 and the extension springs 322 so as to satisfy the foregoing expressions (1) to (4).

As described above, the plate supplying apparatus 1 allows, when taking out a plate from the cassette and transporting the plate to the image recording apparatus, the support section 33 to operate such that the pivot angle of the support section 33 follows an optimum path based on the type of a plate P to be transported, and therefore it is possible to prevent a plate P to be transported from getting damaged and to prevent a plate P being transported from falling. Thus, a slip sheet for preventing friction between plates does not need to be provided between plates P stored in the cassette 2, and therefore the number of man-hours needed to provide the slip sheets alternately between plates is reduced and accordingly the mechanism for taking out slip sheets from the cassette 2 can be withdrawn from the plate supplying apparatus 1, whereby a great cost reduction is achieved. In addition, as for the control of the pivot operation of the support section 33, it is not necessary to control the pivot position of the support section 33, and a rotation drive pulse RP can be easily generated so as to synchronize with a linear motion drive pulse DP outputted from the control section of the image recording apparatus 8. Moreover, in the plate supplying apparatus 1, when a plate P stored in the cassette 2 is held via suction, only the suction pads 31 are brought into contact with a plate P to be transported, and when the plate P is transported by the transport rollers 51 and 52, the suction pads 31 do not contact with the plate P. Therefore, the occurrence of damage to a plate P to be transported can be further prevented and a stable transport of a plate P is achieved.

The plate supplying apparatus 1 can supply plates P to various image recording apparatuses such as, for example, an external drum scanner in which a plate P is mounted on the outer surface of a recording drum and an internal drum scanner in which a plate P is mounted on the inner surface of a recording drum.

In the above description, the cassette 2 which is placed in the plate supplying apparatus 1 is placed in a slanting position, but needless to say, even if the cassette 2 is placed horizontally, the present invention can be realized.

In the present embodiment, the cassette 2 is manually inserted into and ejected from the plate supplying apparatus 1 at will by means of a cassette carriage. However, the cassette 2 may be automatically removed from the plate supplying apparatus 1 with the use of, for example, an automatic cassette removal device, such as the one disclosed in Japanese Patent Laid-Open Publication No. 2000-351460 (U.S. Pat. No. 6,341,932).

Moreover, the projection length of the pad rod 331 and the pad mounting plate 333 from the pad frame 334 may be adjustable by a motor, etc. With this configuration, even if the number of plates P stored in the cassette 2 varies greatly, a plate P can be adequately sucked by the suction pads 31. In the case of changing the projection length of the pad rod 331 and the pad mounting plate 333 from the pad frame 334, it is preferable to change the drive pattern of the linear motion drive mechanism and the rotation drive mechanism in accordance with such a change.

If a change in the projection length of the pad rod 331 and the pad mounting plate 333 from the pad frame 334 is possible, it is possible to intentionally expand or contract the pad rod 331 multiple times when a plate P is taken out from the cassette 2. Thus, even if another plate P is adhered to the backside of a plate P being taken out, the adhered plate P can be shaken off.

A plurality of pattern tables may contain a pattern in which the degree of change in the angle of rotation is a linear function of the amount of horizontal movement.

While the invention has been described in detail, the foregoing description is in all aspects illustrative and not restrictive. It is understood that numerous other modifications and variations can be devised without departing from the scope of the invention.

What is claimed is:

1. A plate supplying apparatus for transporting and supplying a stack of plates one by one while reversing faces of each plate, the apparatus comprising:

a storage section for storing a stack of plates;

a plate suction section for sucking around an end portion of a plate to be transported which is stored in the storage section;

a support section for supporting the plate suction section;

a linear motion drive mechanism for moving the plate suction section and the support section in a plate transport direction;

a rotation drive mechanism for turning the plate sucked by the plate suction section by pivoting the plate suction section and the support section, independently of the movement of the plate suction section and the support section in the plate transport direction;

a linear motion drive mechanism control section for controlling an operation of the plate suction section and the linear motion drive mechanism;

a rotation drive mechanism control section for controlling the rotation drive mechanism so as to allow the plate suction section and the support section to pivot, in accordance with a predetermined rotation drive pattern table, at a pivot angle in association with a linear motion position of the support section in the plate transport direction; and a supplying section for supplying the plate sucked by the plate suction section and transported toward another equipment device, wherein the rotation drive pattern table, which defines the pivot angle of the plate suction section and the support section in association with the linear motion position of the support section in the plate transport direction, and of which a plurality are prepared, is adapted to the plates expected to be stored in the storage section; and the rotation drive pattern table selected from the plurality of the rotation drive pattern tables is used, based on plate information indicating various information relating to the plate, by the rotation drive mechanism control section.

2. The plate supplying apparatus according to claim 1, wherein the rotation drive mechanism control section controls the rotation drive mechanism at the pivot angle at which, until the plate is removed from the storage section, the end portion of the plate follows a line deviated from at least a reference path, which is an arc of a circle whose center is an other end portion of the plate and whose radius is the length of the plate, toward the other end portion of the plate.

3. The plate supplying apparatus according to claim 2, wherein:

the rotation drive mechanism control section performs a separation operation by controlling the rotation drive mechanism at the pivot angle at which the amount of deviation of the end portion from the reference path is greater at a point when the end portion of the plate has just been lifted off other plates stored in the storage section than elsewhere in the plate transport direction.

4. The plate supplying apparatus according to claim 2, wherein:

the rotation drive mechanism control section controls the rotation drive mechanism at the pivot angle at which a ratio of the pivot angle to the amount of movement of the support section in the plate transport direction is different between before and after the plate is removed from the storage section.

5. The plate supplying apparatus according to claim 1, wherein:

the linear motion drive mechanism control section generates linear motion drive pulses for driving the linear motion drive mechanism and outputs the linear motion drive pulses to the linear motion drive mechanism; and the rotation drive mechanism control section generates rotation drive pulses for driving the rotation drive mechanism, by removing at least one of the linear motion drive pulses generated by the linear motion drive mechanism control section, and outputs the rotation drive pulses to the rotation drive mechanism.

6. The plate supplying apparatus according to claim 5, wherein:

the rotation drive pattern table describes whether or not to drive the rotation drive mechanism in association with the linear motion position of the support section in the plate transport direction in accordance with the plates stored in the storage section;

the rotation drive mechanism control section includes a rotation drive pattern memory in which the rotation drive pattern table is prestored; and the rotation drive mechanism control section retrieves, by referring to the rotation drive pattern table, information about whether or not to drive the rotation drive mechanism with respect to a linear motion position address calculated using the linear motion drive pulses, and generates, if the rotation drive mechanism is not driven, the rotation drive pulses.

7. The plate supplying apparatus according to claim 6, wherein:

the rotation drive pattern memory has prestored therein a plurality of the rotation drive pattern tables; and the rotation drive pattern table used by the rotation drive mechanism control section when generating the rotation drive pulses, is selected by an instruction of the linear motion drive mechanism control section.

8. The plate supplying apparatus according to claim 7, wherein, in the rotation drive pattern table, a pattern for taking out the plate from the storage section is different from a pattern for moving the plate suction section and the support section toward the storage section.

9. The plate supplying apparatus according to claim 7, wherein the plurality of the rotation drive pattern tables are prestored in the rotation drive pattern memory in accordance with the size, type, or remaining number of plates stored in the storage section.

10. The plate supplying apparatus according to claim 1, wherein:

the support section supports the plate suction section via compression springs so as to move up and down; and when the plate suction section sucks a plate stored in the storage section, the plate suction section is moved and placed in a direction outward from a center of pivot of the plate suction section and the support section by means of its weight and a pressing force of the compression springs.

11. The plate supplying apparatus according to claim 10 further comprises:

a roller section for supporting the plate, which is provided in the plate suction section via extension springs so as to move up and down; and roller guide rails for guiding, when the plate supported by the plate suction section and the roller section is taken out to the supplying section, the roller section to a predetermined position with respect to the center of pivot, and wherein, when the plate is taken out to the supplying section, suction by the plate suction section is terminated and the plate suction section is moved and placed in a direction inward toward the center of pivot by means of its weight.

12. The plate supplying apparatus according to claim 1, wherein the storage section includes a cassette which stores the plates in a position slanted with respect to vertical.

13. The plate supplying apparatus according to claim 12, wherein the plate transport direction is a horizontal direction.

14. The plate supplying apparatus according to claim 13, wherein:

the plates are stored in the cassette such that their image recording layers face downwards; and the plate suction section sucks a support layer of one of the plates stored in the cassette, the support layer being an opposite side of the image recording layer.

15. The plate supplying apparatus according to claim 14, wherein:

the equipment device comprises a cylindrical recording drum on which one of the plates is mounted around a perimeter of the recording drum such that the image recording layer faces outwards.

16. The plate supplying apparatus according to claim 15, wherein the linear motion drive mechanism includes:

linear shafts which extend horizontally;

linear motion bases which travel along the linear shafts; and a motor for allowing the linear motion bases to travel along the linear shafts, wherein:

the plate suction section and the support section are placed so as to rotate freely with respect to the linear motion bases; and the rotation drive mechanism includes a motor for rotating the plate suction section and the support section with respect to the linear motion bases, which is secured to the linear motion bases.

* * * * *